US010513124B2

(12) United States Patent
Takahashi et al.

(10) Patent No.: US 10,513,124 B2
(45) Date of Patent: Dec. 24, 2019

(54) LIQUID CARTRIDGE INCLUDING MOVABLE MEMBER HAVING CONTACT SURFACE

(71) Applicant: BROTHER KOGYO KABUSHIKI KAISHA, Nagoya-shi, Aichi-ken (JP)

(72) Inventors: Hiroaki Takahashi, Nagoya (JP); Takahiro Miyao, Nagoya (JP); Akihito Ono, Nagoya (JP); Tetsuro Kobayashi, Nagoya (JP); Fumio Nakazawa, Okazaki (JP); Kosuke Nukui, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/939,460

(22) Filed: Mar. 29, 2018

(65) Prior Publication Data

US 2019/0100018 A1 Apr. 4, 2019

(30) Foreign Application Priority Data

Sep. 29, 2017 (JP) ..... 2017-189577

(51) Int. Cl.
*B41J 2/175* (2006.01)

(52) U.S. Cl.
CPC ..... *B41J 2/17513* (2013.01); *B41J 2/1753* (2013.01); *B41J 2/17523* (2013.01); *B41J 2/17543* (2013.01)

(58) Field of Classification Search
CPC .. B41J 2/17513; B41J 2/17523; B41J 2/1753; B41J 2/17543

(Continued)

(56) References Cited

U.S. PATENT DOCUMENTS 5,506,611 A 4/1996 Ujita et al.
8,007,091 B2 8/2011 Nakamura et al.
(Continued)

FOREIGN PATENT DOCUMENTS

EP 2 524 810 A1 11/2012
EP 3 225 401 A1 10/2017
(Continued)

OTHER PUBLICATIONS

Extended European Search Report issued in related European Patent Application No. 18165164.7, dated Sep. 10, 2018.
(Continued)

*Primary Examiner* — Stephen D Meier
*Assistant Examiner* — Alexander D Shenderov
(74) *Attorney, Agent, or Firm* — Merchant & Gould P.C.

(57) ABSTRACT

There is provided a liquid cartridge configured to be inserted into a cartridge-attachment section in an insertion direction crossing a gravitational direction and accommodated in the cartridge-attachment section in an upright posture. The liquid cartridge includes a casing, a movable member movably supported by the casing, and a circuit board provided at the movable member and facing upward in the upright posture. The movable member includes a receiving portion providing a receiving space that is open in the insertion direction and in a widthwise direction orthogonal to the insertion direction and the gravitational direction for receiving a protruding portion of the cartridge-attachment section in the insertion direction and in the widthwise direction. The receiving portion has a contact surface defining the receiving space and facing downward. The contact surface extends in the insertion direction and the widthwise direction and is configured to contact the protruding portion of the cartridge-attachment section.

25 Claims, 16 Drawing Sheets

(58) Field of Classification Search
USPC ..... 347/86
See application file for complete search history.

(56) References Cited

U.S. PATENT DOCUMENTS

| | | | | |
|---|---|---|---|---|
| 2006/0164482 | A1 | 7/2006 | Katayama et al. | |
| 2010/0225704 | A1 | 9/2010 | Aoki et al. | |
| 2014/0168324 | A1* | 6/2014 | Sasaki | B41J 2/17523 347/86 |
| 2016/0200114 | A1 | 7/2016 | Nanjo et al. | |
| 2016/0279959 | A1* | 9/2016 | Okazaki | B41J 2/17543 |
| 2017/0066248 | A1 | 3/2017 | Ono | |
| 2017/0282580 | A1 | 10/2017 | Takahashi et al. | |
| 2018/0003704 | A1 | 1/2018 | Horii et al. | |

FOREIGN PATENT DOCUMENTS

| | | | |
|---|---|---|---|
| EP | 3 228 460 | A1 | 10/2017 |
| JP | 2006-349936 | A | 12/2006 |
| JP | 2013-49164 | A | 3/2013 |
| JP | 2016-185650 | A | 10/2016 |
| JP | 2016-185651 | A | 10/2016 |
| JP | 2017-52219 | A | 3/2017 |
| WO | 2017/130242 | A1 | 8/2017 |

OTHER PUBLICATIONS

International Search Report and Written Opinion issued in related International Patent Application No. PCT/JP2018/013097, dated Jun. 5, 2018.

Extended European Search Report issued in related European Patent Application No. 18165153.0, dated Sep. 21, 2018.

Office Action issued in related U.S. Appl. No. 15/939,388, dated Nov. 6, 2018.

Office Action issued in related U.S. Appl. No. 15/939,671, dated Nov. 16, 2018.

Office Action issued in related U.S. Appl. No. 15/939,671, dated Jul. 11, 2019.

* cited by examiner

LIQUID CARTRIDGE INCLUDING MOVABLE MEMBER HAVING CONTACT SURFACE

CROSS REFERENCE TO RELATED APPLICATION

This application claims priority from Japanese Patent Application No. 2017-189577 filed Sep. 29, 2017. The entire content of the priority application is incorporated herein by reference.

TECHNICAL FIELD

The present disclosure relates to a liquid cartridge configured to store liquid therein, and a system including the liquid cartridge, and an attachment section to which the liquid cartridge is attachable.

BACKGROUND

As a conventional system well-known in the art, there is known a system including an ink cartridge, and an inkjet-recording apparatus provided with an attachment section to which the ink cartridge is detachably attachable.

The ink cartridge is provided with a circuit board. The circuit board includes a memory for storing such information as color and material of ink, and a storage capacity for the ink. Electrodes are also formed on the circuit board. The electrodes are electrically connected to contacts provided in the attachment section of the inkjet-recording apparatus in a state where the ink cartridge is attached to the attachment section. Through these connections, the inkjet-recording apparatus can read information stored in the memory.

The electrodes and contacts should be positioned accurately in order to ensure reliable electrical connections between the electrodes and the contacts in the state where the ink cartridge is attached to the attachment section. For example, Japanese Patent Application Publication No. 2013-049164 discloses a recording apparatus and an ink cartridge therefor. The ink cartridge includes a main body, a bracket capable of moving vertically relative to the main body, and a circuit board provided on the bracket. By making the bracket movable in a vertical direction relative to the main body, the circuit board can be independently positioned in the vertical direction relative to the main body.

SUMMARY

In the above-mentioned recording apparatus, a rod provided in an attachment section is inserted through a hole formed in a front end portion of the bracket during insertion of the ink cartridge into the attachment section. The rod functions to raise the bracket in order to provide vertical positioning of the circuit board supported on the bracket. In this case, the circuit board must be arranged near the rod in a front-rear direction so that the circuit board can be positioned vertically with precision by the inserted rod. In other words, the circuit board must be disposed near a front end of the ink cartridge. However, this configuration compromises flexibility in arranging the circuit board.

In view of the foregoing, it is an object of the present disclosure to provide a liquid cartridge capable of realizing vertical positioning of a circuit board without compromising flexibility in arrangement of the circuit board.

In order to attain the above and other objects, according to one aspect, the present disclosure provides a liquid cartridge configured to be inserted into a cartridge-attachment section in an insertion direction crossing a gravitational direction and accommodated in the cartridge-attachment section in an upright posture. The cartridge-attachment section includes a protruding portion extending in the insertion direction and having a width in a widthwise direction orthogonal to the insertion direction and the gravitational direction. The liquid cartridge includes a casing, a movable member movably supported by the casing, and a circuit board provided at the movable member. The casing includes: a liquid chamber storing liquid therein; and a liquid passage extending from the liquid chamber in the insertion direction in the upright posture. The circuit board faces upward in the upright posture. The movable member is movable relative to the casing and includes a receiving portion adapted to receive the protruding portion of the cartridge-attachment section in the insertion direction and in the widthwise direction. The receiving portion provides a receiving space that is open in the insertion direction and in the widthwise direction. The receiving portion has a contact surface defining the receiving space. The contact surface faces downward and extends in the insertion direction and the widthwise direction in the upright posture. The contact surface is configured to contact the protruding portion of the cartridge-attachment section.

According to another aspect, the present disclosure can also be embodied as a liquid cartridge configured to be inserted into a cartridge-attachment section in an insertion direction crossing a gravitational direction and accommodated in the cartridge-attachment section in an upright posture. The liquid cartridge includes: a casing defining therein a liquid chamber configured to store liquid therein; a liquid passage extending from the liquid chamber in the insertion direction in the upright posture; a movable member movably supported by the casing, the movable member being movable relative to the casing in the vertical direction in the upright posture; and a circuit board provided at the movable member and facing upward in the upright posture. The movable member is formed with a recess at a position closer to the circuit board than to the liquid passage in the vertical direction in the upright posture. The movable member has a contact surface defining the recess. The contact surface faces downward and extends in the insertion direction and a widthwise direction orthogonal to the insertion direction and the vertical direction in the upright posture. The recess is open in the insertion direction and in the widthwise direction in the upright posture.

According to still another aspect, the present disclosure can also be embodied as a liquid cartridge configured to be inserted into a cartridge-attachment section in an insertion direction crossing a gravitational direction and accommodated in the cartridge-attachment section in an upright posture. The cartridge-attachment section includes a protruding portion extending in the insertion direction and having a width in a widthwise direction orthogonal to the insertion direction and the gravitational direction. The liquid cartridge includes: a casing; a movable member movably supported by the casing; and a circuit board provided at the movable member and facing upward in the upright posture. The casing includes a liquid chamber configured to store liquid therein, and a liquid passage extending from the liquid chamber in the insertion direction in the upright posture. The movable member includes a receiving portion providing a receiving space that is open in the insertion direction and in the widthwise direction. The receiving portion has a contact surface defining the receiving space. The contact surface faces downward and extending in the insertion direction and the widthwise direction in the upright posture. The movable member is moved relative to the casing by contact of the contact surface with the protruding portion during entry of the protruding portion into the receiving portion in the insertion direction in accordance with the insertion of the liquid cartridge into the cartridge-attachment section.

DETAILED DESCRIPTION

Figure 1:
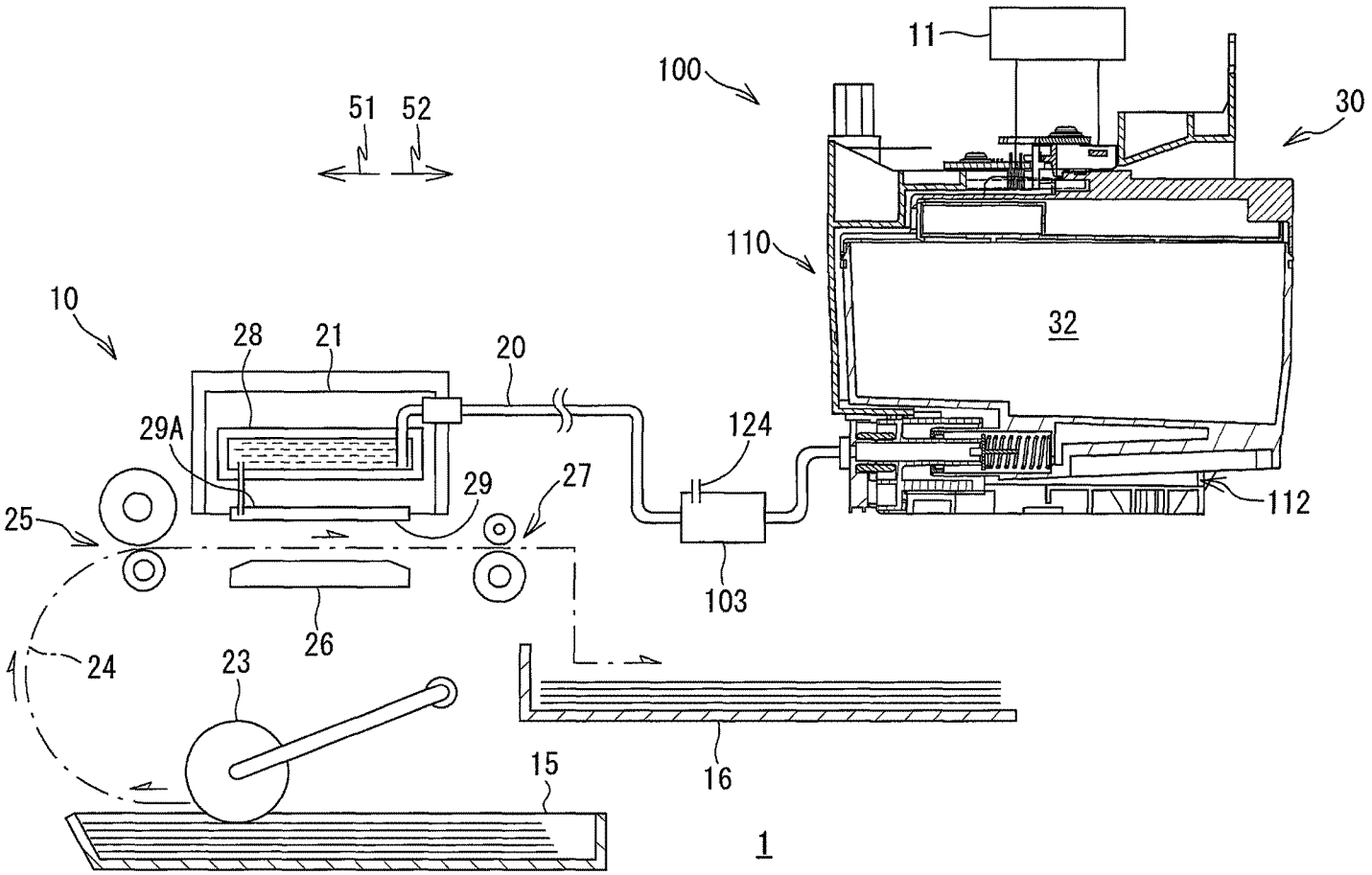
FIG. 1 is a schematic cross-sectional diagram conceptually illustrating a system including an ink cartridge according to a first embodiment of the present disclosure and a printer including a cartridge-attachment section configured to detachably accommodate the ink cartridge according to the first embodiment, and conceptually illustrating an internal configuration of the printer.

Hereinafter, embodiments of the disclosure will be described in detail while referring to accompanying drawings. It would be apparent to those skilled in the art that the embodiments described below are merely examples of the present disclosure and modifications and variations may be made therein without departing from the scope of the disclosure.

[First Embodiment]

In the following description, a frontward direction 51 is defined as a direction in which an ink cartridge 30 according to a first embodiment of the present disclosure is inserted into a cartridge-attachment section 110 according to the first embodiment. In the present embodiment, the ink cartridge 30 is configured to be inserted in an insertion direction orthogonal to a gravitational direction. A rearward direction 52 is defined as a direction opposite the frontward direction 51, that is, a direction in which the ink cartridge 30 is extracted from the cartridge-attachment section 110. The frontward direction 51 and rearward direction 52 are horizontal in the present embodiment, i.e., are directions crossing the gravitational direction. Further, a downward direction 53 is defined as the gravitational direction, while an upward direction 54 is defined as a direction opposite the downward direction 53. Further, a rightward direction 55 and a leftward direction 56 are defined as directions orthogonal to the frontward direction 51 and the downward direction 53. More specifically, in a state where the ink cartridge 30 is attached to the cartridge-attachment section 110 (i.e., in the state illustrated in FIGS. 4-6), the rightward direction 55 is defined as a direction extending rightward and the leftward direction 56 as a direction extending leftward when the ink cartridge 30 is viewed from its rear side. The rightward direction 55 and the leftward direction 56 are parallel to a horizontal direction in the present embodiment.

Further, in the following description, the frontward direction 51 and the rearward direction 52 may be collectively referred to as a front-rear direction. The upward direction 54 and the downward direction 53 may be collectively referred to as an up-down direction or a vertical direction. The rightward direction 55 and the leftward direction 56 may be collectively referred to as a left-right direction.

In the state where the ink cartridge 30 is completely attached to the cartridge-attachment section 110, the ink cartridge 30 has a height in the up-down direction; a depth in the front-rear direction (i.e., in the insertion direction); and a width in the left-right direction (i.e., widthwise direction).

<Overview of Printer 10>

FIG. 1 schematically illustrates a system 1 configured of the ink cartridge 30 and a printer 10 according to the first embodiment. First, a detailed structure of the printer 10 will be described with reference to FIG. 1.

The printer 10 is configured to record images by selectively ejecting ink droplets onto sheets based on an inkjet recording system. The printer 10 includes an ink-supplying device 100, a recording head 21, and ink tubes 20 connecting the recording head 21 to the ink-supplying device 100. The ink-supplying device 100 includes the cartridge-attachment section 110.

Specifically, in the embodiment, the cartridge-attachment section 110 can detachably accommodate therein four of the ink cartridges 30 each storing ink of one of four colors of cyan, magenta, yellow, and black that that the printer 10 can use for printing. In FIG. 1, for the sake of simplifying description, only one ink cartridge 30 is depicted to be attached to the cartridge-attachment section 110.

The cartridge-attachment section 110 has a wall formed with an opening 112. The ink cartridges 30 can be inserted into the cartridge-attachment section 110 in the frontward direction 51 (i.e., insertion direction orthogonal to the gravitational direction) through the opening 112, and extracted from the cartridge-attachment section 110 in the rearward direction 52 (i.e., removal direction orthogonal to the gravitational direction) through the opening 112.

The ink cartridges 30 are connected to the recording head 21 through the corresponding ink tubes 20 when the ink cartridges 30 are completely mounted in the cartridge-attachment section 110.

The recording head 21 includes sub tanks 28 each serving to temporarily store ink supplied from the corresponding ink cartridge 30 through the corresponding ink tube 20. The recording head 21 also includes a plurality of nozzles 29 through which the ink supplied from the sub tanks 28 is selectively ejected in accordance with the inkjet recording system. More specifically, the recording head 21 includes a head control board (not shown), and piezoelectric elements 29A corresponding one-on-one to the nozzles 29. The head control board is configured to selectively apply drive voltages to the piezoelectric elements 29A to eject ink of each color selectively from the nozzles 29. In this way, the recording head 21 is configured to consume the ink stored in the respective ink cartridges 30 mounted in the cartridge-attachment section 110.

The printer 10 also includes a sheet tray 15, a sheet feeding roller 23, a conveying path 24, a pair of conveying rollers 25, a platen 26, a pair of discharge rollers 27, and a sheet discharge tray 16. The sheet feeding roller 23 is configured to feed each sheet from the sheet tray 15 onto the conveying path 24, and the conveying rollers 25 are configured to convey the sheet over the platen 26. The recording head 21 is configured to selectively eject ink onto the sheet as the sheet passes over the platen 26, whereby an image is recorded on the sheet. The sheet that has passed the platen 26 is then discharged by the discharge rollers 27 onto the sheet discharge tray 16 disposed at a downstream end of the conveying path 24.

<Ink-Supplying Device 100>

The ink-supplying device 100 is provided in the printer 10, as illustrated in FIG. 1. The ink-supplying device 100 functions to supply ink to the recording head 21. As described above, the ink-supplying device 100 includes the cartridge-attachment section 110 for detachably accommodate the four ink cartridges 30 therein. FIG. 1 depicts a state where the ink cartridge 30 is completely attached to the cartridge-attachment section 110 and thus can be used by the printer 10 (hereinafter, referred to as "attached state"). Note that, a posture of the ink cartridge 30 in the attached state depicted in FIG. 1 will also be referred to as an upright posture, wherever appropriate.

<Cartridge-Attachment Section 110>

Figure 2:
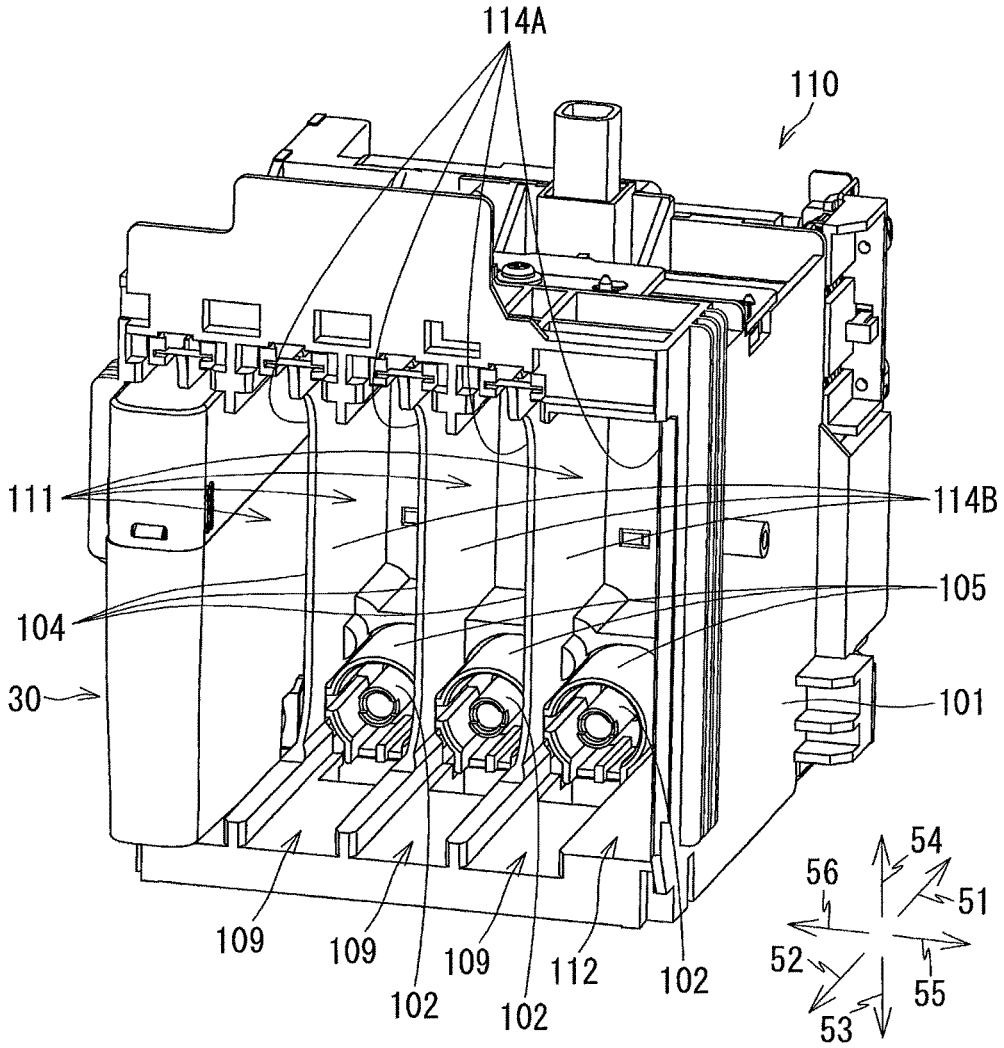
FIG. 2 is a perspective view showing an external appearance of the cartridge-attachment section according to the first embodiment and an opening thereof.
Figure 3:
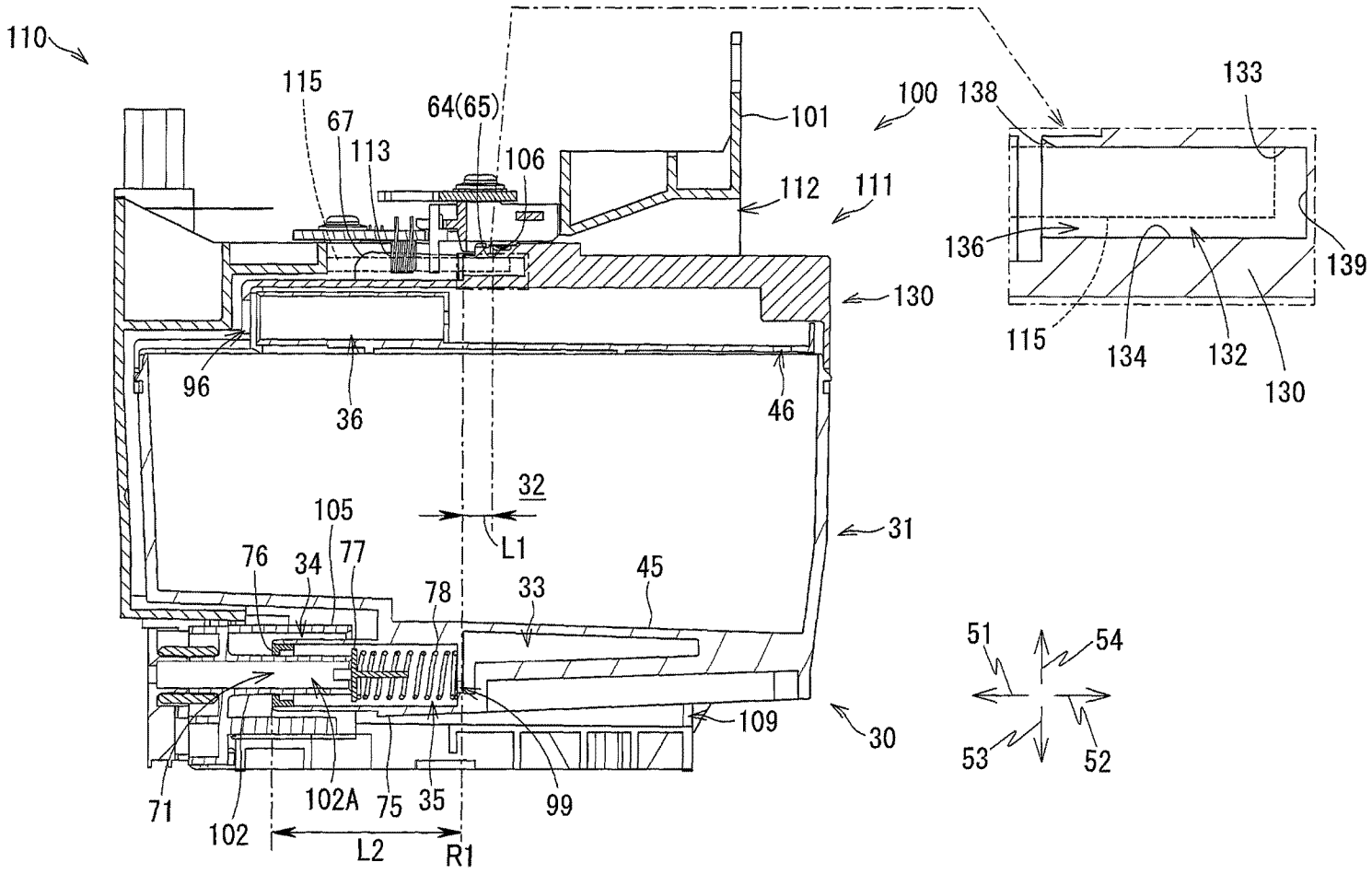
FIG. 3 is a vertical cross-sectional view of the cartridge-attachment section according to the first embodiment, illustrating a state where the ink cartridge according to the first embodiment is accommodated in the cartridge-attachment section.

As illustrated in FIGS. 1 through 3, the cartridge-attachment section 110 includes a case 101, and four sets of: a protruding portion 115, an ink needle 102, a tank 103, an optical sensor 113 and four contacts 106, each set for each of the four ink cartridges 30 corresponding to the ink colors cyan, magenta, yellow, and black.

<Case 101>

The case 101 constitutes a housing of the cartridge-attachment section 110. As depicted in FIG. 2, the case 101 has a box-like shape defining an internal space therein. Specifically, the case 101 includes: a top wall defining a ceiling of the internal space; a bottom wall defining a bottom of the internal space; an end wall defining a front end of the internal space and connecting the top wall and the bottom wall; and the opening 112 positioned opposite the end wall in the front-rear direction. The opening 112 can be exposed to a surface (user-interface surface) that a user faces when using the printer 10.

The case 101 also includes three plates 104 that partition the internal space into four accommodation spaces 111 each elongated in the up-down direction. The four ink cartridges 30 can be accommodated in the respective accommodation spaces 111. That is, in the case 101, the top wall, the bottom wall and the end wall of the case 101 define ceilings, bottoms and front ends of the four accommodation spaces 111, respectively.

Each of the four ink cartridges 30 can be inserted into and removed from the corresponding one of the accommodation spaces 111 of the case 101 through the opening 112. Each of the four ink cartridges 30 can also be extracted from the corresponding one of the accommodation spaces 111 of the cartridge case 101 through the opening 112. In the case 101, the bottom wall is formed with four guide grooves 109 for guiding insertion/removal of the corresponding ink cartridges 30. Specifically, when the ink cartridges 30 are inserted into and removed from the case 101 through the opening 112, lower ends of the respective ink cartridges 30 are received in the corresponding guide grooves 109 and guided thereby in the front-rear direction.

<Ink Needle 102>

Each ink needle 102 is formed of a resin and is tubular shaped. That is, the ink needles 102 are hollow. As illustrated in FIG. 2, the ink needles 102 are disposed at a lower end portion of the end wall constituting the case 101. Specifically, each ink needle 102 is disposed on the end wall at a position corresponding to an ink supply portion 34 (described later) of the corresponding ink cartridge 30 mounted in the cartridge-attachment section 110. The ink needles 102 protrude rearward from the end wall of the case 101.

Both rear end (distal end) and front end (proximal end) of each ink needle 102 are open. The rear end of each ink needle 102 is inserted into an ink supply port 71 formed in the ink supply portion 34 of the corresponding ink cartridge 30. The front end of each ink needle 102 is either directly or indirectly connected to the corresponding ink tube 20 (see FIG. 1). Accordingly, an interior space 102A of the ink needle 102 is in communication with the corresponding tank 103 and the recording head 21 via an interior space of the corresponding ink tube 20.

As illustrated in FIGS. 2 and 3, a cylindrical-shaped guide portion 105 is provided at the end wall to surround the corresponding ink needle 102. Each guide portion 105 protrudes rearward from the end wall. Each guide portion 105 has a protruding end that is open rearward. Specifically, each ink needle 102 is arranged at a diametrical center of the corresponding guide portion 105. The guide portions 105 are shaped to allow the ink supply portions 34 of the corresponding ink cartridges 30 to be received therein.

During insertion of the ink cartridge 30 into the cartridge-attachment section 110 in the frontward direction 51, the ink supply portion 34 of the ink cartridge 30 enters into the corresponding guide portion 105 (refer to FIG. 3). As the ink cartridge 30 is inserted further forward, the ink needle 102 enters into an ink valve chamber 35 of the corresponding ink cartridge 30 through the ink supply port 71 formed in the ink supply portion 34. The ink needle 102 is thus connected to the corresponding ink supply portion 34, and the interior space 102A of the ink needle 102 is in communication with the ink valve chamber 35 formed in the ink supply portion 34. Hence, ink stored in a second storage chamber 33 formed inside the ink cartridge 30 is allowed to flow out of the second storage chamber 33, through the ink valve chamber 35 and the interior space 102A of the corresponding ink needle 102, and into the corresponding tank 103 (see FIG. 1). The ink flowing out of the tank 103 passes through the corresponding ink tube 20 and flows into the recording head 21.

Incidentally, the distal end of each ink needle 102 may be flattened or pointed. Also, the guide portions 105 may be formed into any shape, provided that the guide portions 105 can allow the ink cartridges 30 to be placed in the attached state in the cartridge-attachment section 110. Still alternatively, the guide portions 105 may be omitted from the cartridge-attachment section 110.

<Contacts 106>

Figure 8B:
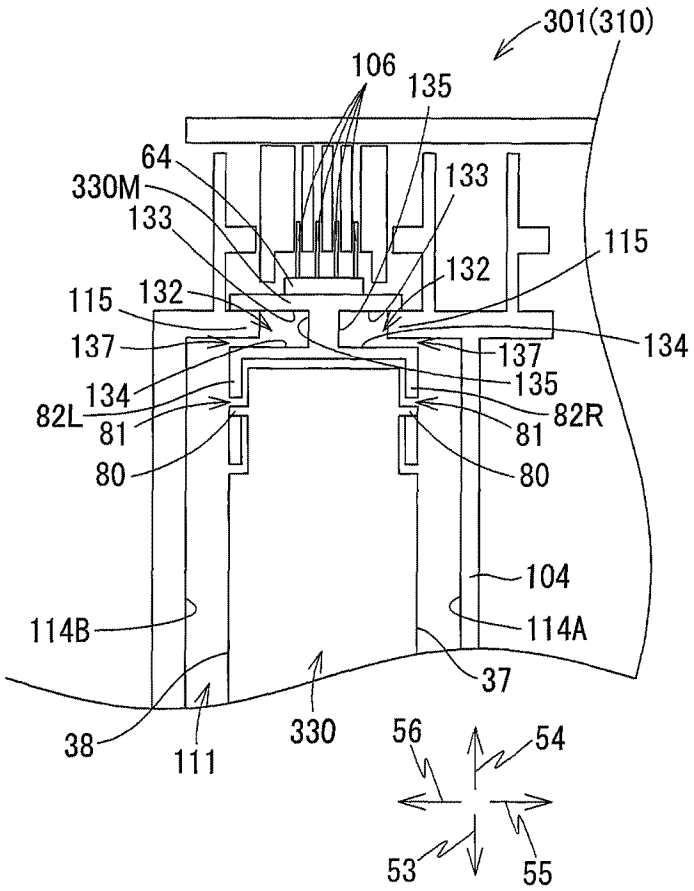
FIG. 8B is a partially-enlarged schematic cross-sectional view of a cartridge-attachment section according to a variation of the first embodiment taken along a plane extending in vertical and left-right directions and passing through recessed portions of an ink cartridge according to the variation accommodated in the cartridge-attachment section, wherein a protruding portion protrudes from each of side surfaces of a case constituting the cartridge-attachment section according to the variation.
Figure 8A:
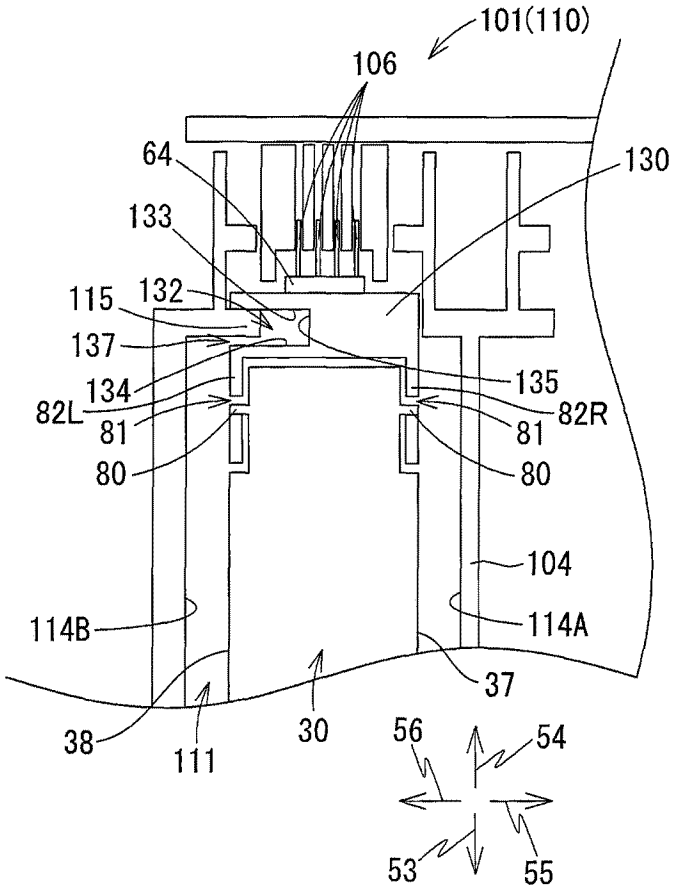
FIG. 8A is a partially-enlarged schematic cross-sectional view of the cartridge-attachment section according to the first embodiment taken along a plane extending in vertical and left-right directions and passing through a recessed portion of the ink cartridge according to the first embodiment accommodated in the cartridge-attachment section, wherein a protruding portion protrudes from a side surface of a case constituting the cartridge-attachment section.

As illustrated in FIGS. 3 and 8A, the four contacts 106 are disposed at the top wall of the case 101 inside the corresponding one of the accommodation spaces 111. Four sets of the four contacts 106 are provided each set for one of the four ink cartridges 30 attachable to the case 101. The contacts 106 face downward. The contacts 106 are configured of a material having electrical conductivity and resiliency. The contacts 106 are therefore upwardly resiliently deformable. Further, as illustrated in FIG. 8A, the four contacts 106 provided in each accommodation space 111 are aligned to be spaced apart from one another in the left-right direction. Arrangement of the four contacts 106 in each set corresponds to the arrangement of four sets of electrodes 65 of the corresponding ink cartridge 30, as will be described later. Note that the number of contacts 106 and the number of electrodes 65 may be arbitrary.

The contacts 106 are electrically connected to a controller 11 (see FIG. 1) of the printer 10 via an electric circuit. The controller 11 includes a CPU, a ROM, and a RAM, for example. By placing the contacts 106 in contact with the corresponding electrodes 65 so that electricity can be conducted therebetween, a voltage Vc is applied to the electrodes 65, the electrodes 65 are grounded, and power is supplied to the electrodes 65. Further, when electricity can be conducted between the contacts 106 and corresponding electrodes 65, data stored in an IC (integrated circuit) of the ink cartridge 30 is accessible. Output from the electric circuit is inputted into the controller 11.

<Optical Sensor 113>

The optical sensors 113 are disposed at the top wall of the case 101. Specifically, as illustrated in FIG. 3, each optical sensor 113 is disposed frontward of the corresponding set of four contacts 106 in each accommodation space 111. Each optical sensor 113 includes a light-emitting portion and a light-receiving portion. The light-emitting portion is arranged on the right or on the left of the light-receiving portion with a gap formed therebetween. When the ink cartridge 30 is fully attached to the cartridge-attachment section 110, a light-blocking plate 67 (also see FIG. 4) of the attached ink cartridge 30 is located between the light-emitting portion and the light-receiving portion of the corresponding optical sensor 113. In other words, the light-emitting portion and the light-receiving portion are arranged to oppose each other with the light-blocking plate 67 of the ink cartridge 30 fully attached to the cartridge-attachment section 110 interposed between the light-emitting portion and the light-receiving portion.

The optical sensor 113 is configured to output detection signals to the controller 11 (FIG. 1) that differ according to whether or not the corresponding light-receiving portion receives light emitted from the light-emitting portion in the left-right direction. For example, the optical sensor 113 outputs a low-level signal to the controller 11 when the light-receiving portion cannot receive the light emitted from the light-emitting portion (that is, when an intensity of the light received at the light-receiving portion is less than a predetermined intensity). On the other hand, the optical sensor 113 outputs a high-level signal when the light-receiving portion can receive the light emitted from the light-emitting portion (that is, when the intensity of the received light is equal to or greater than the predetermined intensity).

<Protruding Portion 115>

As illustrated in FIG. 2, pairs of side surfaces 114A and 114B opposing each other in the left-right direction define right and left ends of each of the four accommodation spaces 111 in the cartridge case 101 that are partitioned by the plates 104. Hence, each ink cartridge 30 is positioned between the pair of side surfaces 114A and 114B when inserted into the cartridge case 101. The side surface 114A defines the right end of the corresponding accommodation space 111, while the side surface 114B defines the left end of the corresponding accommodation space 111.

As illustrated in FIG. 8A, in each accommodation space 111, the protruding portion 115 protrudes rightward from an upper end portion of the side surface 114B. As shown in FIG. 3, the protruding portion 115 is elongated in the front-rear direction. The protruding portion 115 has such a dimension in the front-rear direction that: a front end portion of the protruding portion 115 is positioned at a front end of the side surface 114B (near the end wall of the cartridge case 101); and a rear end portion of the protruding portion 115 is positioned directly beneath an inner top surface 133 (described later) provided in the ink cartridge 30 when the ink cartridge 30 is mounted in the ink-supplying device 100.

The rear end portion of the protruding portion 115 is also positioned directly beneath the contacts 106 of the corresponding accommodation space 111. Note that the rear end portion of the protruding portion 115 may instead be positioned further rearward or further forward than the corresponding contacts 106. However, it is preferable to position the rear end portion of the protruding portion 115 either at the same front-rear position as the contacts 106 or farther rearward relative to the contacts 106.

<Tank 103>

As illustrated in FIG. 1, the tanks 103 are provided forward of the case 101. Each tank 103 has a box-like shape that allows ink to be stored therein. A top portion of each tank 103 is open to the outside through an air communication port 124. Accordingly, interior spaces in the respective tanks 103 are opened to the atmosphere. The interior space of each tank 103 is in communication with the interior space 102A of the corresponding ink needle 102. With this structure, ink flowing out of the ink cartridge 30 passes through the ink needle 102 and is stored in the corresponding tank 103. Each tank 103 is also connected to the corresponding ink tube 20. Thus, the ink stored in the interior space of each tank 103 is supplied to the recording head 21 through the corresponding ink tube 20.

<Ink Cartridge 30>

Figure 4:
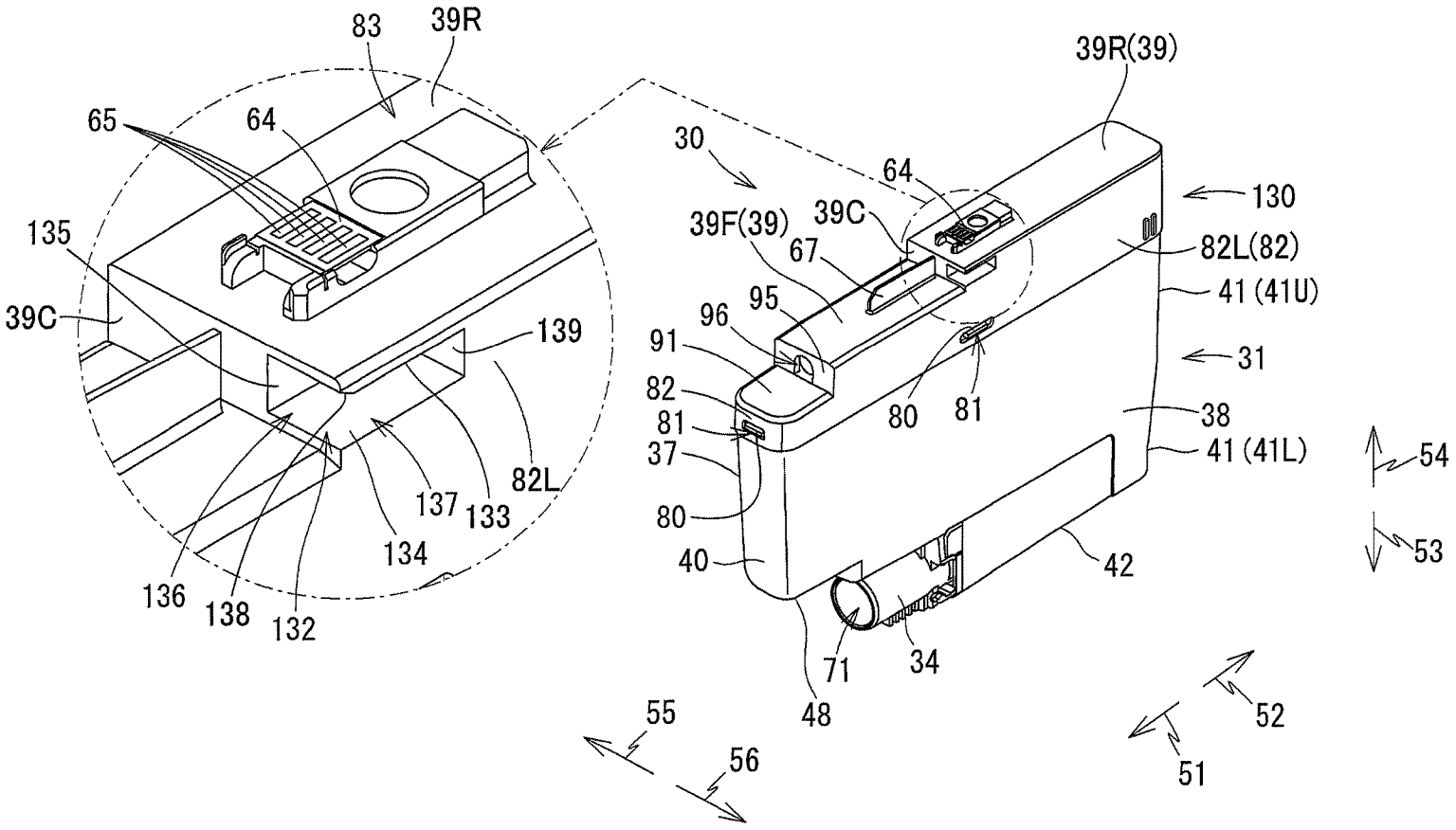
FIG. 4 is a perspective view of the ink cartridge according to the first embodiment as viewed from its front side.

The ink cartridge 30 depicted in FIGS. 4 and 5 is a container configured to store ink therein. In FIGS. 4 and 5, the ink cartridge 30 is in its upright posture. That is, the ink cartridge 30 fully attached to the cartridge-attachment section 110 is in the upright posture illustrated in FIGS. 4 and 5. The ink cartridge 30 can be therefore used in the printer 10 when in the attached state or in the upright posture. In the following description of the ink cartridge 30, up, down, front, rear, left, and right directions relative to the ink cartridge 30 are defined assuming that the ink cartridge 30 is in its upright posture.

The ink cartridge 30 has an overall flattened shape in which its left-right dimension is narrow and its vertical and front-rear dimensions are greater than the left-right dimension.

The ink cartridge 30 includes a casing 31 and a movable member 130. The casing 31 defines therein a first storage chamber 32 and the second storage chamber 33 (see FIG. 6) configured to store ink. The movable member 130 is positioned upward of the casing 31. The movable member 130 includes a top wall 39 constituting a top wall of the ink cartridge 30. Details of the movable member 130 will be described later.

The casing 31 includes a front wall 40, a rear wall 41, a partitioning wall 44, a bottom wall 42, and a pair of side walls 37 and 38. The front wall 40 and rear wall 41 are spaced apart from each other in the front-rear direction. The partitioning wall 44 and bottom wall 42 are separated from each other vertically. The partitioning wall 44 is positioned above the bottom wall 42. The side walls 37 and 38 are separated from each other in the left-right direction. The partitioning wall 44 and bottom wall 42 are provided between the front wall 40 and rear wall 41 in the front-rear direction. The side walls 37 and 38 are provided between the front wall 40 and rear wall 41 in the front-rear direction and between the partitioning wall 44 and bottom wall 42 in the up-down direction. Each of the front wall 40, rear wall 41, partitioning wall 44, bottom wall 42, and side walls 37 and 38 defines at least one of the first storage chamber 32, the second storage chamber 33, and an air communication chamber 36 in the ink cartridge 30.

Note that, in the upright posture, a direction from the rear wall 41 toward the front wall 40 coincides with the frontward direction 51; a direction from the front wall 40 toward the rear wall 41 coincides with the rearward direction 52; a direction from the top wall 39 toward the bottom wall 42 coincides with the downward direction 53; a direction from the bottom wall 42 toward the top wall 39 coincides with the upward direction 54; a direction from the side wall 38 to the side wall 37 coincides with the rightward direction 55; and a direction from the side wall 37 to the side wall 38 coincides with the leftward direction 56.

Also, in the attached state (upright posture), the front wall 40 faces frontward; the rear wall 41 faces rearward, the bottom wall 42 faces downward, and the top wall 39 faces upward. In other words, in the upright posture of the ink cartridge 30, a front surface of the front wall 40 faces frontward, a rear surface of the rear wall 41 faces rearward, a bottom surface of the bottom wall 42 faces downward, an upper surface of the top wall 39 faces upward, a right surface of the side wall 37 faces rightward, and a left surface of the side wall 38 faces leftward.

In the casing 31, at least the rear wall 41 has light-transmissive property so that a level of ink stored in the storage chambers 32 and 33 is visible from the outside.

Figure 5B:
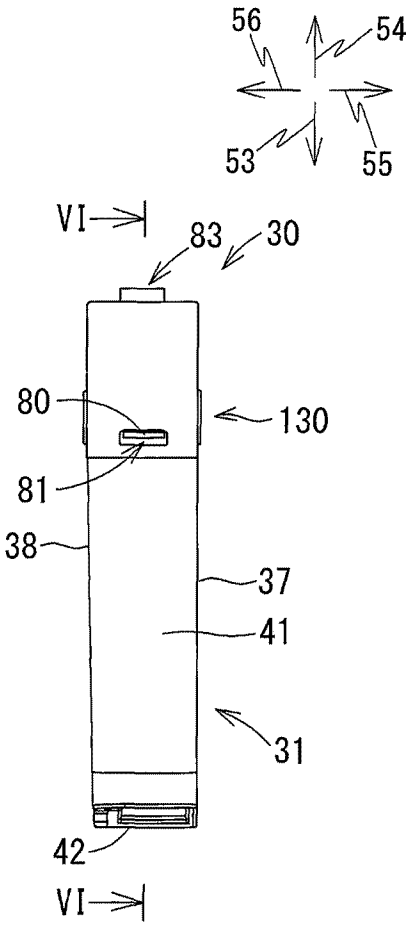
FIG. 5B is a rear side view of the ink cartridge according to the first embodiment.
Figure 5A:
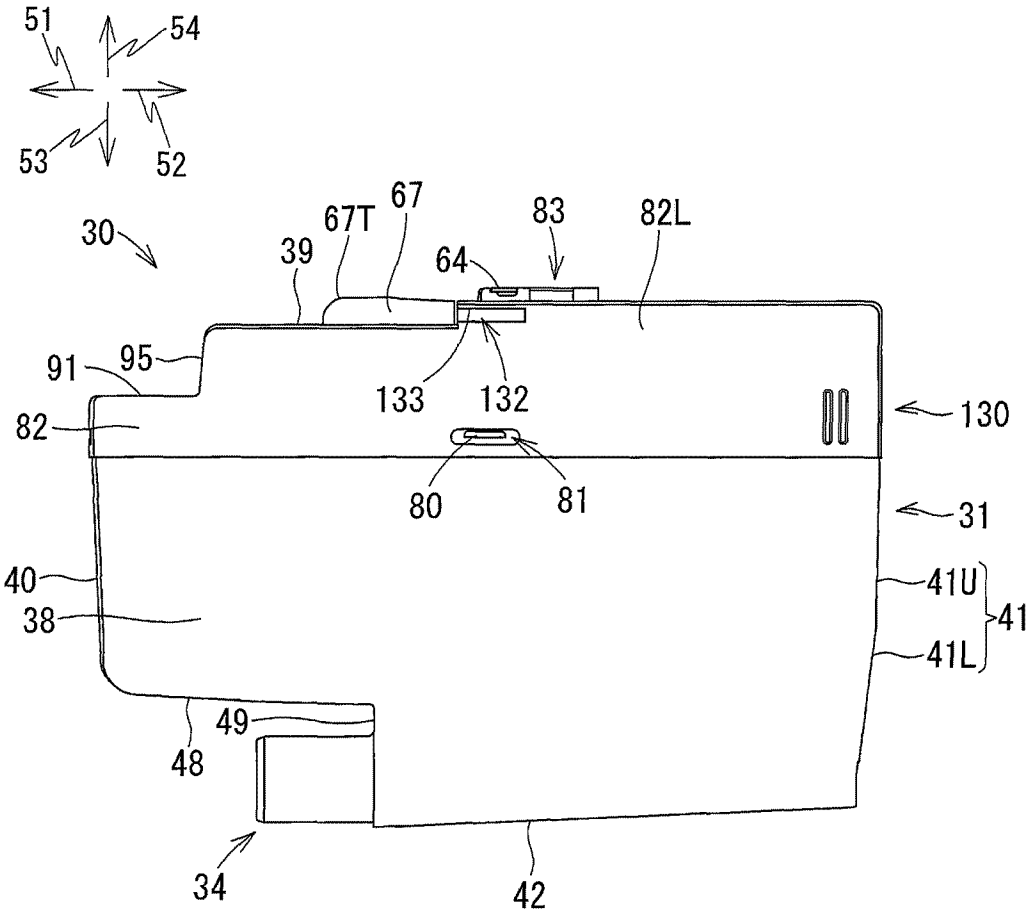
FIG. 5A is a right side view of the ink cartridge according to the first embodiment.
Figure 6:
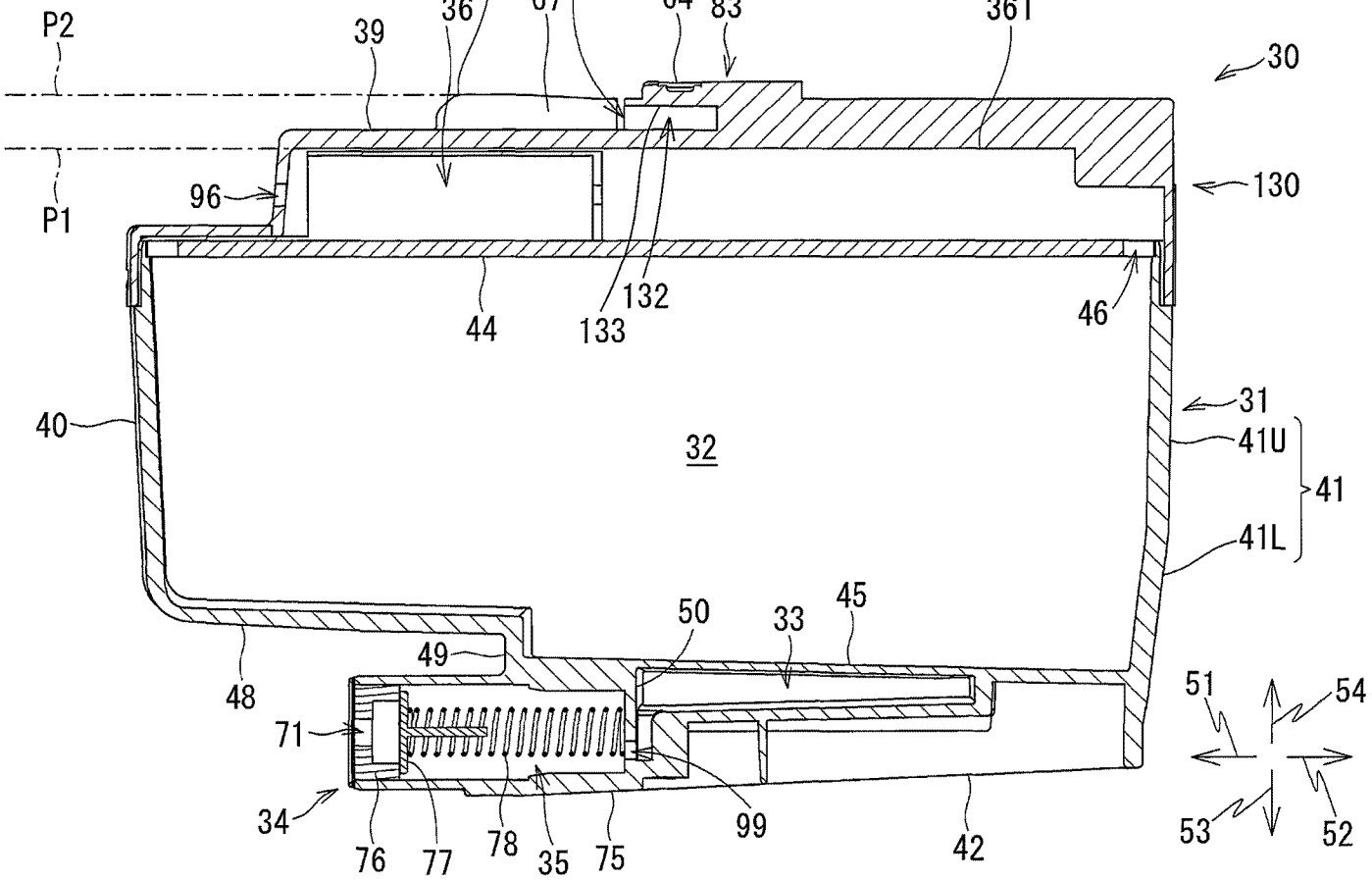
FIG. 6 is a cross-sectional view of the ink cartridge according to the first embodiment taken along a plane VI-VI shown in FIG. 5B.

As illustrated in FIGS. 4 to 6, the rear surface of the rear wall 41 includes an upper portion 41U and a lower portion 41L. The upper portion 41U is positioned upward of the lower portion 41L. The lower portion 41L is positioned forward of the upper portion 41U. Both of the upper portion 41U and lower portion 41L are flat surfaces. The upper portion 41U and lower portion 41L cross each other but are not orthogonal to each other. Specifically, the lower portion 41L is sloped relative to the vertical direction so as to extend closer to the front surface 40 toward the bottom wall 42.

The bottom surface of the bottom wall 42 is inclined relative to the front-rear direction such that a front end thereof is positioned lower than a rear end thereof. Preferably, the bottom surface of the bottom wall 42 is sloped at an angle of 2° to 4° relative to the horizontal direction. The bottom wall 42 has a rear edge connected to a bottom edge of the lower portion 41L of the rear wall 41.

The casing 31 also includes a sub-bottom wall 48 and a sub-front wall 49. The sub-bottom wall 48 is positioned higher than the bottom wall 42. The sub-bottom wall 48 extends continuously rearward from a bottom edge of the front wall 40. In the present embodiment, a front end of the sub-bottom wall 48 is positioned farther frontward than a front end of the ink supply portion 34, and a rear end of the sub-bottom wall 48 is positioned farther rearward relative to the front end of the ink supply portion 34. The sub-front wall 49 connects the bottom wall 42 to the sub-bottom wall 48. The ink supply portion 34 extends forward from the sub-front wall 49 at a position below the sub-bottom wall 48 and above the bottom wall 42. Note that the front end of the sub-bottom wall 48 may be arranged at an arbitrary position, for example, at a position farther rearward than the front end of the ink supply portion 34.

As illustrated in FIGS. 4 and 5, the casing 31 also includes a plurality of protrusions 80 one each provided on each of upper end portions of the front surface of the front wall 40, the rear surface of the rear wall 41, the right surface of the side wall 37 and the left surface of the side wall 38. Each protrusion 80 protrudes away from the corresponding surface of the casing 31. In the present embodiment, one protrusion 80 is arranged on each of the front wall 40, the rear wall 41, the side wall 37 and the side wall 38. However, the number and layout of the protrusions 80 should not be limited to those of the embodiment. For example, the protrusions 80 may not be arranged on the front wall 40 and rear wall 41, but may be provided only on the side wall 37 and side wall 38. Alternatively, for example, one protrusion 80 may be arranged on each of the front wall 40 and rear wall 41, while two protrusions 80 may be arranged on each of the side wall 37 and side wall 38.

Note that, the front wall, rear wall, top wall, bottom wall, and side walls of the ink cartridge 30 need not each be configured of a single wall. For example, in the present embodiment, the sub-front wall 49 and a sub-front wall 95 described later constitute the front wall of the ink cartridge 30 together with the front wall 40; the sub-bottom wall 48 constitutes the bottom wall of the ink cartridge 30 together with the bottom wall 42; and a sub-top wall 91 described later (see FIG. 5) constitutes the top wall of the ink cartridge 30 together with the top wall 39.

Further, the front surface of the front wall 40, rear surface of the rear wall 41, top surface of the top wall 39, bottom surface of the bottom wall 42, right surface of the side wall 37, and left surface of the side wall 38 constituting the ink cartridge 30 need not be formed as single flat surfaces, respectively.

The front surface of the front wall 40 is a surface that is visible when viewing the ink cartridge 30 in its upright posture from its front side and that is positioned forward of a front-rear center of the ink cartridge 30 in its upright posture. In the present embodiment, the front surface of the sub-front wall 49 connecting the bottom wall 42 to the sub-bottom wall 48 may be considered part of the front surface of the front wall of the ink cartridge 30 together with the front surface of the front wall 40 connecting the sub-bottom wall 48 to the top wall 39. As an alternative, the sub-bottom wall 48 may be omitted from the ink cartridge 30. In other words, the front surface of the front wall 40 may constitute a single surface continuously connecting the top wall 39 to the bottom wall 42.

Similarly, the rear surface of the rear wall 41 is a surface that is visible when viewing the ink cartridge 30 in its upright posture from its rear side and that is positioned rearward of the front-rear center of the ink cartridge 30 in its upright posture.

The upper surface of the top wall 39 of the movable member 130 is a surface that is visible when viewing the ink cartridge 30 in its upright posture from its upper side and that is positioned upward of a vertical center of the ink cartridge 30 in its upright posture.

The bottom surface of the bottom wall 42 is a surface that is visible when viewing the ink cartridge 30 in its upright posture from its bottom side and that is positioned downward of the vertical center of the ink cartridge 30 in its upright posture.

The right surface of the side wall 37 is a surface that is visible when viewing the ink cartridge 30 in its upright posture from its right side and that is positioned rightward of a left-right center of the ink cartridge 30 in its upright posture.

The left surface of the side wall 38 is a surface that is visible when viewing the ink cartridge 30 in its upright posture from its left side and that is positioned leftward of the left-right center of the ink cartridge 30 in its upright posture.

<Movable Member 130>

As shown in FIGS. 4, 5A, and 5B, the movable member 130 includes the top wall 39, the sub-top wall 91, the sub-front wall 95, and a peripheral wall 82. The movable member 130 is a box-shaped member with an open bottom. The movable member 130 is disposed on the top of the casing 31.

The movable member 130 has a right end that is flush with the right surface of the side wall 37 in the left-right direction, and a left end that is flush with the left surface of the side wall 38 in the left-right direction. However, the right end of the movable member 130 may be positioned farther rightward or leftward than the right surface of the side wall 37, and the left end of the movable member 130 may be positioned farther rightward or leftward than the left surface of the side wall 38. In such cases, preferably, the right end of the movable member 130 be positioned farther leftward than the right surface of the side wall 37; and the left end of the movable member 130 be positioned farther rightward than the left surface of the side wall 38. In other words, preferably, the right and left ends of the movable member 130 do not protrude farther outward in corresponding right and left directions than the casing 31.

Openings 81 are formed in the peripheral wall 82 of the movable member 130. The openings 81 are provided at positions corresponding to the protrusions 80 on the casing 31. Thus, the protrusions 80 are inserted into the corresponding openings 81 when the movable member 130 is fitted over the casing 31. Here, the number and layout of the openings 81 are modified to conform to the number and layout of protrusions 80. The openings 81 have a greater vertical dimension than the protrusions 80. Hence, in the upright posture, the casing 31 supports the movable member 130 so that the movable member 130 can move vertically relative to the casing 31.

The movable member 130 drops downward by its own weight when no external forces are applied to the ink cartridge 30. At this time, upper edges defining the tops of the openings 81 are supported on the corresponding protrusions 80, as illustrated in FIG. 5. Through this arrangement, the movable member 130 is supported on the casing 31. As will be described later, the movable member 130 moves upward when pushed from below by the corresponding protruding portion 115 of the cartridge-attachment section 110. At this time, the openings 81 move upward relative to the protrusions 80, thereby forming vertical gaps between the upper edges of the openings 81 and the corresponding protrusions 80, as illustrated in FIG. 8A.

More specifically, referring to FIG. 4, the top wall 39 has stepped structure, with a rear portion 39R higher than a front portion 39F. Thus, a vertical surface 39C extends vertically to connect the top wall 39 to the front portion 39F. That is, the vertical surface 39C is a surface facing frontward. This vertical surface 39C is positioned rearward relative to a rear end of the ink valve chamber 35 in the front-rear direction.

The sub-top wall 91 is positioned frontward of the top wall 39 (front portion 39F). The sub-front wall 95 connects the top wall 39 (front portion 39F) and the sub-top wall 91. The peripheral wall 82 extends downward from peripheral outer edges of the sub-top wall 91 and the top wall 39 (rear portion 39R and front portion 39F).

As depicted in FIG. 6, inside the movable member 130, the air communication chamber 36 is formed. The air communication chamber 36 is partitioned from the first storage chamber 32 by the partitioning wall 44. However, the air communication chamber 36 and the first storage chamber 32 are in communication with each other through a through-hole 46 formed in the partitioning wall 44.

<Protruding Portion 83>

As depicted in FIGS. 4 and 5A, a protruding portion 83 is provided on the top wall 39 of the movable member 130, more specifically, on the rear portion 39R of the top wall 39. The protruding portion 83 supports an IC board 64 thereon.

<IC Board 64>

As illustrated in FIGS. 4, 5A and 8A, the circuit board 64 is supported from below on the protruding portion 83 of the movable member 130. The IC board 64 is arranged to face upward in the upright posture. In the upright posture, the IC board 64 is a plate extending in the left-right direction and front-rear direction.

Although not shown in detail in the drawings, the IC board 64 is bonded to the protruding portion 83 of the movable member 130 by photopolymer (photo-curable resin). Note that the IC board 64 may be bonded to the movable member 130 using an adhesive rather than a photopolymer or may be mounted on the protruding portion 83 through a fitting process or method other than bonding.

As shown in FIG. 3, the circuit board 64 contacts and becomes electrically connected to the corresponding contacts 106 during the insertion of the ink cartridge 30 into the cartridge-attachment section 110. This contact and electrical connection with the contacts 106 is maintained when the ink cartridge 30 is in its attached state in the cartridge-attachment section 110.

As shown in FIG. 4, the circuit board 64 is fabricated by mounting an IC (not illustrated in the drawings) and the four electrodes 65 on a substrate formed of a silicone or glass epoxy, for example. Note that the circuit board 64 may also be a flexible printed circuit board.

The IC is a semiconductor integrated circuit. Information related to the ink cartridge 30 can be stored on and read from the IC. The information related to the ink cartridge 30 may include data specifying its lot number, manufactured date, ink colors used, and the like Each of the electrodes 65 is electrically connected to the IC. Each electrode 65 extends in the front-rear direction. The electrodes 65 are juxtaposed in the left-right direction on a top surface of the circuit board 64 and are spaced apart from one another. Each electrode 65 is exposed on the top surface of the circuit board 64 so as to be electrically accessible.

<Light-Blocking Plate 67>

As illustrated in FIGS. 4 to 6, the light-blocking plate 67 is provided on the upper surface of the top wall 39 (front portion 39F) to protrude upward therefrom. The light-blocking plate 67 extends in the front-rear direction. The light-blocking plate 67 is positioned frontward of the protruding portion 83 in the front-rear direction. The light-blocking plate 67 is positioned frontward and downward relative to the IC board 64.

In the present embodiment, the light-blocking plate 67 is a plate made of resin containing a colored material capable of absorbing light (carbon black pigment, for example). Alternatively, the light-blocking plate 67 may be configured by attaching a material that cannot transmit light, such as aluminum, to a side surface of a plate capable of transmitting light.

The light-blocking plate 67 is configured to block the light of the optical sensor 113 traveling in the left-right direction. More specifically, when the light emitted from the light-emitting portion of the optical sensor 113 is incident on the light-blocking plate 67 before arriving at the light-receiving portion, the intensity of light received at the light-receiving portion becomes less than a predetermined intensity, for example, zero. Note that the light-blocking plate 67 may block or attenuate the light traveling in the left-right direction from the light-emitting portion to the light-receiving portion. Alternatively, the light-blocking plate 67 may change a traveling direction of the light traveling to the light-receiving portion from the light-emitting portion.

<Air Communication Port 96>

As shown in FIG. 4, the sub-front wall 95 extends upward from a rear edge of the sub-top wall 91 provided frontward of the top wall 39 (front portion 39F). The sub-front wall 95 faces forward. An air communication port 96 is formed in the sub-front wall 95. That is, the air communication port 96 is provided higher than the vertical center of the ink cartridge 30. The air communication port 96 is a substantially circular-shaped through-hole penetrating the sub-front wall 95 in the front-rear direction. The air communication port 96 is in communication with the air communication chamber 36 and is thus in communication with the first storage chamber 32 via the through-hole 46.

The air communication port 96 is closed by a seal (not shown) that can be peeled off the sub-front wall 95. The seal is peeled off the sub-front wall 95 to open the air communication port 96 before the ink cartridge 30 is attached to the cartridge-attachment section 110. The first storage chamber 32 of the ink cartridge 30 is thus opened to the atmosphere. Note the member sealing the air communication port 96 is not restricted to the seal. For example, a well-known valve mechanism may be disposed within the air communication chamber 36 to open and close the air communication port 96.

<Recessed Portion 132>

As illustrated in FIG. 4, the movable member 130 includes a recessed portion 132 that is recessed rearward from the vertical surface 39C and rightward from a left side surface 82L constituting the peripheral wall 82 in the upright posture of the ink cartridge 30. Specifically, as shown in FIGS. 4 and 8A, the recessed portion 132 is defined by the inner top surface 133, an inner bottom surface 134, an inner right surface 135, and an inner rear surface 139.

The inner top surface 133 is a downward-facing surface. That is, the inner top surface 133 faces vertically away from the circuit board 64 that is supported on top of the movable member 130.

The inner top surface 133 defines a ceiling of the recessed portion 132. Put another way, the inner top surface 133 defines a space (receiving space) formed in a location closer to the circuit board 64 disposed on the top of the ink cartridge 30 than to the ink valve chamber 35 formed in the bottom of the ink cartridge 30 in the up-down direction, as illustrated in FIG. 6.

As shown in FIG. 8A, the inner bottom surface 134 is an upward-facing surface that vertically opposes the inner top surface 133. The inner bottom surface 134 defines a bottom of the recessed portion 132. The inner right surface 135 is a leftward-facing surface that defines a right edge of the recessed portion 132. The inner rear surface 139 is a frontward-facing surface that defines a rear edge of the recessed portion 132. The inner right surface 135 has a top edge connected to the inner top surface 133, a bottom edge connected to the inner bottom surface 134, and a rear edge connected to the inner rear surface 139.

As shown in FIG. 4, the recessed portion 132 provides the receiving space that is open frontward and leftward. Put different way, the receiving space beneath the inner top surface 133 is in communication with the outside of the ink cartridge 30 through a first opening 136 and a second opening 137.

The first opening 136 is open toward the front on the vertical surface 39C. The second opening 137 is open toward the left on the left side surface 82L belonging to the peripheral wall 82. More specifically, the second opening 137 is formed on the left side surface 82L at a position rearward relative to the rear end of the ink valve chamber 35 in the front-rear direction. The second opening 137 is continuous with the first opening 136 at a position beneath a left-front corner of the front portion 39F.

As will be described later, the protruding portion 115 of the cartridge-attachment section 110 is adapted to enter into the space beneath the inner top surface 133 (receiving space) through the first opening 136 in the front-rear direction (toward the rear) to be received in the recessed portion 132 during insertion of the ink cartridge 30 into the cartridge-attachment section 110. At the same time, the protruding portion 115 of the cartridge-attachment section 110 also enters into the space beneath the inner top surface 133 (receiving space) through the second opening 137 in the left-right direction (toward the right) to be received in the recessed portion 132 during the insertion of the ink cartridge 30 into the cartridge-attachment section 110.

In the upright posture, a rear edge of the inner top surface 133 is positioned farther rearward than the electrodes 65 of the circuit board 64.

As depicted in FIG. 6, when the ink cartridge 30 is in its upright posture, the inner top surface 133 is positioned above an imaginary plane P1 passing through a top edge 36T of an interior space in the ink cartridge 30 (the first storage chamber 32, second storage chamber 33, and air communication chamber 36). That is, the inner top surface 133 is positioned above the first storage chamber 32, second storage chamber 33, and ink valve chamber 35 configured to store ink.

Also, when the ink cartridge 30 is in its upright posture, the inner top surface 133 is positioned lower than an imaginary plane P2 passing through a top edge 67T of the light-blocking plate 67.

As shown in FIG. 8A, a left edge of the inner top surface 133 is positioned farther leftward than a left edge of the circuit board 64, while a right edge of the inner top surface 133 is positioned farther rightward than a left edge of the circuit board 64. That is, the inner top surface 133 has a portion positioned closer to the side wall 38 than the IC board 64 is to the side wall 38. Put different way, a portion of the inner top surface 133 is positioned offset from the circuit board 64 in the left-right direction. Note that the right edge of the inner top surface 133 may instead be positioned farther leftward than the left edge of the circuit board 64. In other words, the entire inner top surface 133 may be disposed at a different position from the circuit board 64 in the left-right direction.

The left edge of the inner top surface 133 is at the same left-right position as the side wall 38 constituting the casing 31 and is farther leftward than the left edge of the circuit board 64. The right edge of the inner top surface 133 is positioned farther rightward than the side wall 38 of the casing 31 and farther rightward than the left edge of the circuit board 64. Hence, a portion of the inner top surface 133 is positioned between the side wall 38 and circuit board 64 in the left-right direction. Note that the right edge of the inner top surface 133 may be positioned farther leftward than the left edge of the circuit board 64. In other words, the entire inner top surface 133 may be positioned between the side wall 38 and circuit board 64 in the left-right direction.

As illustrated in FIG. 3, the movable member 130 (recessed portion 132) also includes a sloped surface 138 positioned on the front side of the inner top surface 133 and is connected to the inner top surface 133. The sloped surface 138 faces obliquely downward and forward in the upright posture. In the present embodiment, the sloped surface 138 defines the first opening 136 together with the inner right surface 135 and inner bottom surface 134. The sloped surface 138 is positioned farther forward relative to the circuit board 64 in the upright posture. With this arrangement, the inner top surface 133, not the sloped surface 138, can be positioned directly below the circuit board 64. With the protruding portion 115 contacting the inner top surface 133 from below at a position directly beneath the circuit board 64, the cartridge-attachment section 110 can support the movable member 130, as will be described later. This configuration can support the circuit board 64 in a level state.

Note that, while the sloped surface 138 is formed continuously with the inner top surface 133 in the embodiment, the sloped surface 138 need not be formed continuously with the inner top surface 133. Further, the sloped surface 138 may be omitted from the movable member 130.

<Internal Structure of the Casing 31>

As illustrated in FIG. 6, the first ink chamber 32, the second storage chamber 33 and the ink valve chamber 35 are formed inside the casing 31.

Each of the first storage chamber 32, the second storage chamber 33 and the ink valve chamber 35 can store ink. The first storage chamber 32 and the second storage chamber 33 are partitioned by an inner lower wall 45 extending parallel to the partitioning wall 44. That is, the partitioning wall 44 and inner lower wall 45 are both walls in the front-rear direction and in the left-right direction. The inner lower wall 45 and partitioning wall 44 vertically oppose each other.

The first ink chamber 32 is a space that is defined on the top by the bottom surface of the partitioning wall 44, defined on the bottom by the top surface of the inner lower wall 45, and defined on the front, rear, right, and left by inner surfaces of the front wall 40, rear wall 41, and side walls 37 and 38, respectively.

The second storage chamber 33 is positioned below the first storage chamber 32. A volume of ink that can be stored in the second storage chamber 33 is smaller than a volume of ink that can be stored in the first storage chamber 32.

The second storage chamber 33 is a space that is defined on the top by the bottom surface of the lower wall 45, on the bottom by the top surface of the bottom wall 42, and on the rear, right, and left by the inner surfaces of the rear wall 41 and the side walls 37 and 38, respectively. The second storage chamber 33 and ink valve chamber 35 are partitioned by a partition wall 50. The partition wall 50 defines a front end of the second storage chamber 33. The second storage chamber 33 communicates with the first storage chamber 32 through a communication hole (not shown) formed in the lower wall 45. The second storage chamber 33 also communicates with the ink valve chamber 35 via a through-hole 99 formed in the partition wall 50.

The air communication chamber 36 communicates with the atmosphere through the air communication port 96 formed in the sub-front wall 95.

The ink supply portion 34 has a cylindrical outer shape. More specifically, the ink supply portion 34 includes a hollow cylindrical-shaped cylinder 75, and a packing 76. The cylinder 75 protrudes forward from the sub-front wall 49. That is, the ink supply portion 34 is provided on the sub-front wall 49. The cylinder 75 has a front end that is open to the outside of the ink cartridge 30. The cylinder 75 defines an interior space therein that serves as the ink valve chamber 35. The ink valve chamber 35 is elongated in the front-rear direction when the ink cartridge 30 is in the upright posture. The rear end of the ink valve chamber 35 is in communication with the second storage chamber 33 through the through-hole 99. Since the front end of the cylinder 75 is open to the exterior of the ink cartridge 30, the ink valve chamber 35 is in communication with both the second storage chamber 33 and the exterior of the ink cartridge 30. In other words, the ink valve chamber 35 extends in the front-rear direction to allow ink in the second storage chamber 33 to flow forward toward the outside of the ink cartridge 30. The packing 76 is provided in the open front end of the cylinder 75. That is, the packing 76 is disposed at the front end of the ink valve chamber 35.

The ink valve chamber 35 accommodates a valve 77, and a coil spring 78. By moving in the front-rear direction, the valve 77 opens and closes the ink supply port 71 penetrating a center of the packing 76. The coil spring 78 urges the valve 77 forward. Therefore, when no external force is applied to the valve 77, the valve 77 closes the ink supply port 71 in the packing 76.

The packing 76 is a disk-shaped member with a through-hole formed in the center thereof. The packing 76 is formed of an elastic material such as a rubber or elastomer. The through-hole formed in the center of the packing 76 penetrates the same in the front-rear direction to provide a tubular-shaped inner circumferential surface serving as the ink supply port 71. That is, the ink supply port 71 is defined by the tubular-shaped inner circumferential surface that defines the through-hole formed in the packing 76. The ink supply port 71 has an inner diameter that is slightly smaller than an outer diameter of the ink needle 102. The ink supply port 71 provides communication between the interior space of the cylinder 75 (the ink valve chamber 35) and the exterior of the ink cartridge 30.

When the ink cartridge 30 is inserted into the cartridge-attachment section 110 while the valve 77 is closing the ink supply port 71, the ink needle 102 advances into the ink supply port 71, as depicted in FIG. 3. As the packing 76 elastically deforms, the outer circumferential surface of the ink needle 102 forms close contact with the inner circumferential surface defining the ink supply port 71 to provide liquid-tight seal therewith. In other words, communication between the ink valve chamber 35 and the exterior of the ink cartridge 30 via the ink supply port 71 is hermetically sealed. Subsequently, the distal end of the ink needle 102 passes through the ink supply port 71 formed in the packing 76, advances into the ink valve chamber 35, and contacts the valve 77. As the ink cartridge 30 is further inserted into the cartridge-attachment section 110, the ink needle 102 moves the valve 77 rearward against an urging force of the coil spring 78. As a result, ink stored in the ink valve chamber 35 is allowed to flow into the interior space 102A of the ink needle 102.

Note that the ink supply port 71 may be sealed by a film rather than the valve 77. In this case, the ink supply port 71 may be configured of the front end of the cylinder 75 rather than the packing 76. Alternatively, the ink supply port 71 may be formed of an elastic resin or other sealing member that has no through-hole. In this case, the ink supply port 71 may be formed by piercing a needle-like member into the sealing member, and elasticity of the sealing member can reseal the ink supply port 71 when the needle-like member is extracted from the sealing member. Further, the ink supply portion 34 need not be formed as a cylindrically shaped member. For example, a through-hole may be formed in the front wall 40 of the casing 31 to penetrate the front wall 40 in the front-rear direction. In this case, the front wall 40 formed with the through-hole may constitute a portion of the ink supply portion 34.

[Attachment/Detachment of the Ink Cartridge 30 Relative to the Cartridge-Attachment Section 110]

Next, a method for attaching the ink cartridge 30 to the cartridge-attachment section 110 will be described.

As depicted in FIG. 6, prior to attachment of the ink cartridge 30 to the cartridge-attachment section 110, the valve 77 closes the ink supply port 71 formed in the packing 76. This closure interrupts ink outflow from the ink valve chamber 35 to the exterior of the ink cartridge 30. Further, the air communication port 96 is sealed by the removable seal (not shown). Thus the first storage chamber 32 is prevented from being open to the atmosphere.

Before insertion of the ink cartridge 30 into the cartridge-attachment section 110, the user peels off the seal from the air communication port 96. The first storage chamber 32 is opened to the atmosphere accordingly.

Figure 7:
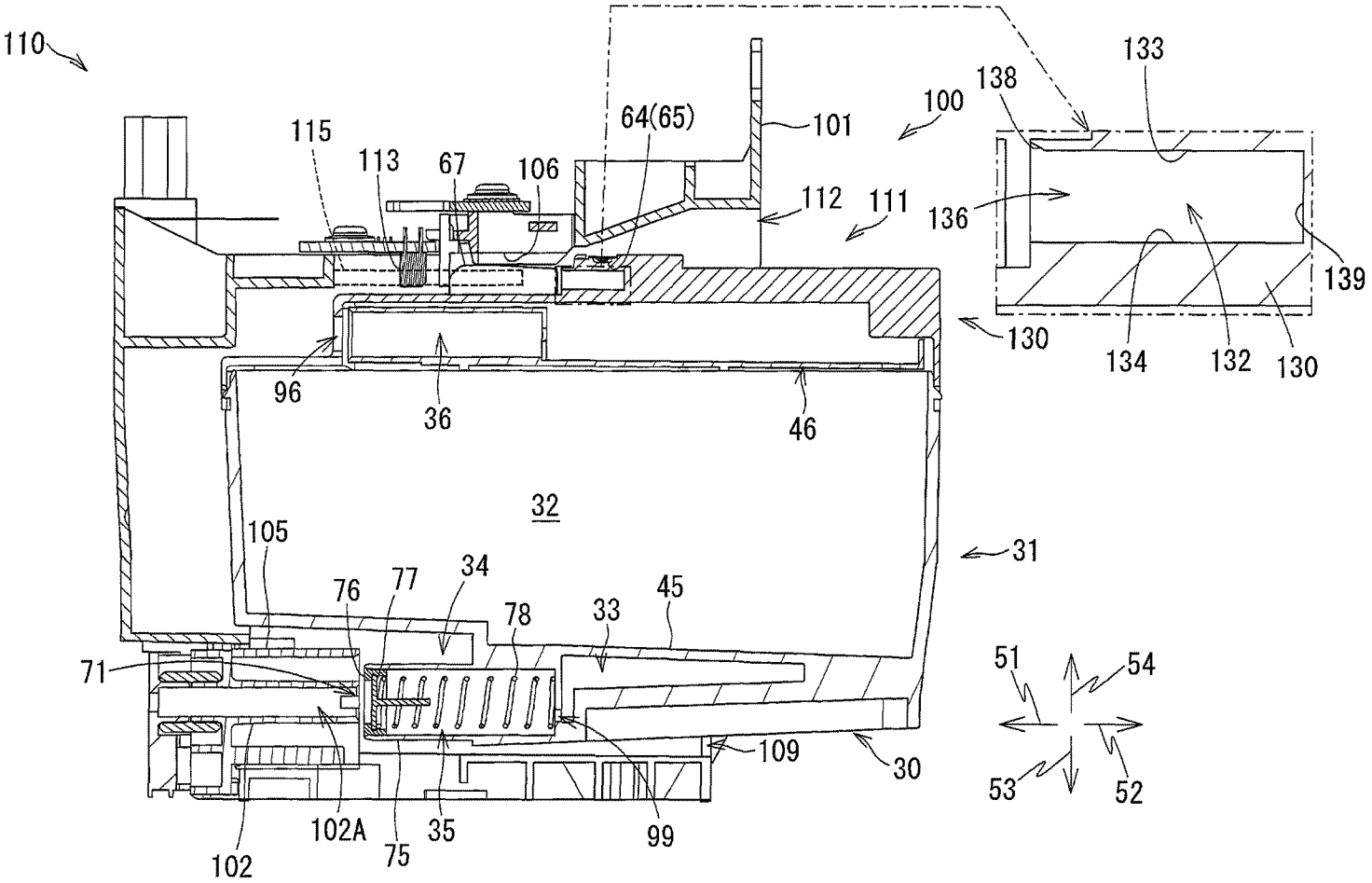
FIG. 7 is a vertical cross-sectional view of the cartridge-attachment section according to the first embodiment, illustrating a state where the ink cartridge according to the first embodiment is being inserted into the cartridge-attachment section.

For attaching the ink cartridge 30 to the cartridge-attachment section 110, the ink cartridge 30 in its upright posture is inserted into the case 101 (see FIG. 2) through the opening 112 of the cartridge-attachment section 110, as illustrated in FIG. 7. The upper portion 41U of the rear wall 41 constituting the casing 31 is positioned farther rearward than the lower portion 41L. That is, the upper portion 41U is positioned closer to the user than the lower portion 41L is to the user. Accordingly, the user pushes against the upper portion 41U forward to insert the ink cartridge 30 into the cartridge-attachment section 110. The lower portion of the ink cartridge 30 advances in the corresponding guide groove 109 formed in the bottom of the case 101 (see FIG. 2).

As the ink cartridge 30 is inserted further into the case 101 (into the corresponding accommodation space 111) from the state shown in FIG. 7, the ink supply portion 34 advances into the corresponding guide portion 105 of the cartridge-attachment section 110, as illustrated in FIG. 3.

In addition, the protruding portion 115 is inserted into the recessed portion 132 formed in the movable member 130. Specifically, the protruding portion 115 is inserted into the space below the inner top surface 133 of the recessed portion 132 (receiving space) through the first opening 136 from its front side in the insertion direction. Here, the sloped surface 138 guides the protruding portion 115 into the recessed portion 132 as the ink cartridge 30 is inserted into the cartridge-attachment section 110. The movable member 130 is pushed from below by the protruding portion 115 and forced to move upward, as the ink cartridge 30 is inserted further forward into the cartridge-attachment section 110.

As described above, the receiving space of the recessed portion 132 is in communication with the outside of the movable member 130 through the first opening 136 and second opening 137. Further, the first opening 136 that is open frontward is formed continuously on its left edge with the second opening 137 that is open leftward (see FIG. 4). Further, the protruding portion 115 protrudes rightward from the side surface 114B (see FIG. 8A). Therefore, as the ink cartridge 30 moves forward relative to the cartridge case 101, the protruding portion 115 can move rearward relative to the recessed portion 132 without being hindered by the surfaces defining the recessed portion 132 (inner top surface 133, inner right surface 135, inner bottom surface 134 and inner rear surface 139). In other words, the protruding portion 115 is inserted into the receiving space of the recessed portion 132 from its front and left sides through the first opening 136 and through the second opening 137, and is moved toward the rear end of the recessed portion 132 (i.e., toward the inner rear surface 139).

As the front wall 40 of the ink cartridge 30 approaches the end wall of the case 101, the ink needle 102 passes through the ink supply port 71 and enters inside the ink valve chamber 35, forcing the valve 77 to separate from the packing 76 against the urging force of the coil spring 78. Through this action, the ink needle 102 is connected to the ink valve chamber 35 and the ink supply portion 34 is fixed in position. The ink stored in the ink valve chamber 35 is allowed to flow into the interior space 102A of the ink needle 102.

The protruding portion 115 inserted into the receiving space of the recessed portion 132 is then received in the recessed portion 132 through the first opening 136 in the front-rear direction (insertion direction) and through the second opening 137 in the left-right direction (widthwise direction). The protruding portion 115 is thus made in contact with the inner top surface 133 defining the receiving space of the recessed portion 132, moving the movable member 130 upward relative to the casing 31. At this time, the IC board 64 on the movable member 130 may or may not be in contact with the contacts 106. That is, the IC board 64 may be made to contact with the contact 106 before or after the movable member 130 is moved upward by the protruding portion 115 received in the recessed portion 132.

In the meantime, the ink cartridge 30 is applied with a rearward urging force generated by the compressed coil spring 78. A magnitude of the urging force generated by the coil spring 78 is determined by a spring constant thereof and a distance by which the coil spring 78 is compressed from its natural length.

In the attached state, i.e., in a state where the ink cartridge 30 inserted forward is completely accommodated in and attached to the cartridge-attachment section 110, the ink cartridge 30 is applied with the rearward urging force generated by the compressed coil spring 78. However, in the present embodiment, a sliding resistance between the ink needle 102 inserted into the ink supply port 71 and the inner circumferential surface of the packing 76 defining the ink supply port 71 (forward force) is greater than this rearward urging force (rearward force). Hence, the ink cartridge 30 is prevented from being forced out of the cartridge-attachment section 110 by the urging force of the coil spring 78. As a result, the ink cartridge 30 can be retained in its attached state in the cartridge-attachment section 110.

Referring to FIG. 3, when the ink cartridge 30 is in the attached state, the circuit board 64 becomes positioned below the contacts 106. Since the movable member 130 has been moved upward as described above, the electrodes 65 on the circuit board 64 are made in contact with the contacts 106. Specifically, the electrodes 65 on the circuit board 64 contact and resiliently deform the contacts 106 upward, forming an electrical connection between the circuit board 64 and contacts 106.

In the attached state, the light-blocking plate 67 is also positioned between the light-emitting portion and light-receiving portion of the optical sensor 113, thereby blocking the passage of light from the light-emitting portion to the light-receiving portion. As described above, the optical sensor 113 is arranged so that the light-blocking plate 67 is positioned in the optical path of light emitted from the light-emitting portion during the attached state.

In the attached state, the protruding portion 115 of the cartridge-attachment section 110 is also in contact with the inner top surface 133 of the movable member 130 from below to support the movable member 130.

Here, referring to FIG. 3, assume that an imaginary plane R1 is a vertical plane passing through a point of contact between the protruding portion 115 and the inner top surface 133 (in the present embodiment, the imaginary plane R1 passes through the front edge of the inner top surface 133, i.e., a boundary edge between the sloped surface 138 and inner top surface 133) in the attached state of the ink cartridge 30 to the cartridge-attachment section 110. At this time, a distance L1 between the imaginary plane R1 and the circuit board 64 in the front-rear direction is shorter than a distance L2 between the imaginary plane R1 and the ink supply port 71 in the front-rear direction.

More specifically, in the present embodiment, the distance L1 is a distance in the front-rear direction between the imaginary plane R1 and a front edge of the IC board 64; and the distance L2 is a distance in the front-rear direction between the imaginary plane R1 and a front end of the ink supply port 71. That is, the protruding portion 115 is in contact with the inner top surface 133 at a position closer to the IC board 64 than to the ink supply port 71 in the front-rear direction.

In the attached state, the inner top surface 133 of the movable member 130 is also positioned below the contacts 106.

In the attached state, the circuit board 64 is positioned farther rearward than the ink needle 102.

Further, in the attached state, the electrodes 65 of the circuit board 64 contact the contacts 106 from below. That is, the electrodes 65 resiliently deform the contacts 106 upward, forming an electrical connection with the same. At this time, the IC board 64 is urged downward by the resilient deformed contacts 106. However, since the protruding portion 115 supports the movable member 130 from below through the contact with the inner top surface 133, the IC board 64 can keep resiliently deforming the contacts 106.

To remove the ink cartridge 30 from the cartridge-attachment section 110, the user grips the rear portion of the ink cartridge 30 and pulls the ink cartridge 30 rearward. When a sum of the force pulling the ink cartridge 30 rearward and the urging force of the coil spring 78 (rearward force) is greater than the sliding friction between the ink needle 102 and the inner circumferential surface of the packing 76 (forward force), the ink cartridge 30 moves rearward relative to the cartridge-attachment section 110. At this time, the user can remove the ink cartridge 30 from the cartridge-attachment section 110.

[Detection on Whether the Ink Cartridge 30 is Attached to the Cartridge-Attachment Section 110]

Next, operations for detecting the ink cartridge 30 being inserted in the cartridge-attachment section 110 will be described with reference to flowcharts in FIGS. 9 and 10.

Figure 9:
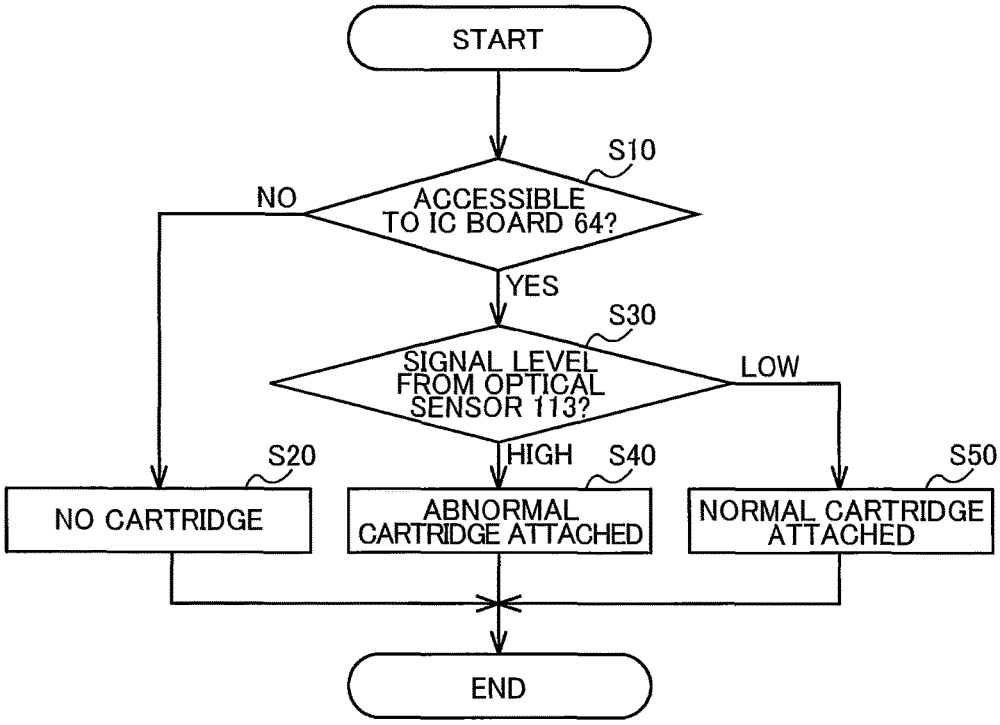
FIG. 9 is a flowchart illustrating steps for detecting insertion of the ink cartridge according to the first embodiment into the cartridge-attachment section according to the first embodiment.
Figure 10:
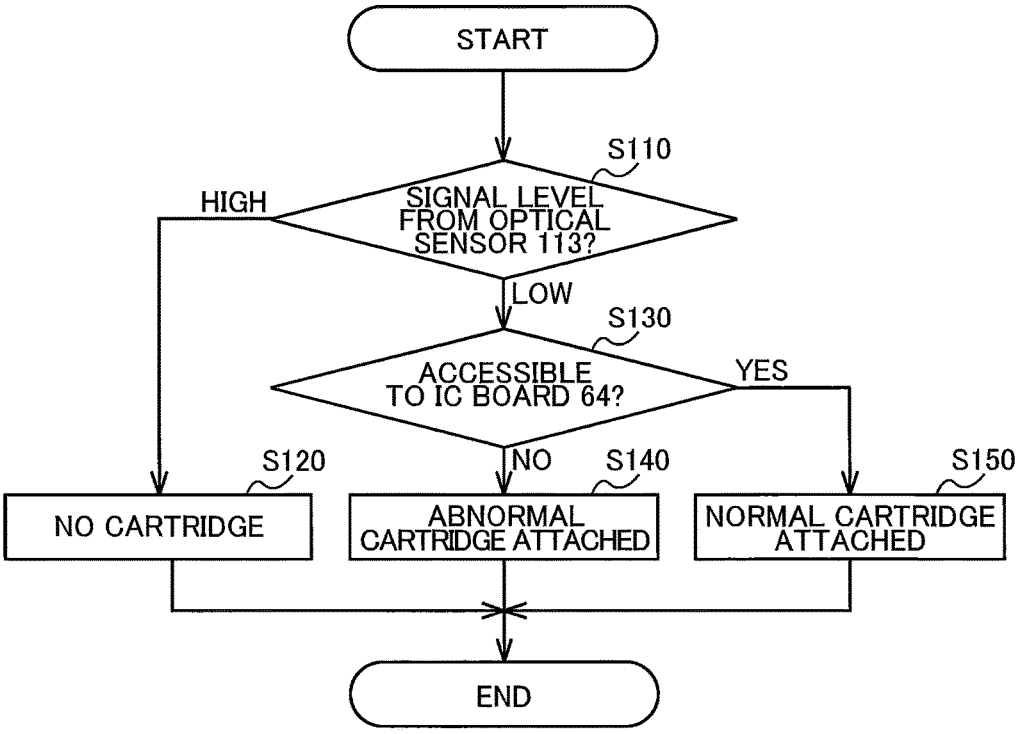
FIG. 10 is a flowchart illustrating another way of detecting insertion of the ink cartridge according to the first embodiment into the cartridge-attachment section according to the first embodiment.

Note that the controller 11 is configured to start the processing illustrated in the flowcharts in FIGS. 9 and 10 once a cover (not shown) for opening and closing the opening 112 of the cartridge-attachment section 110 is detected to be closed.

First, steps of the flowchart in FIG. 9 will be described.

Referring to FIG. 9, once detecting that the cover (not shown) is closed, the controller 11 (see FIG. 1) is configured to determine in S10 whether the circuit board 64 of the ink cartridge 30 is accessible. When the contacts 106 are in contact with the circuit board 64 so as to be electrically connected to the same, the controller 11 can access the circuit board 64. When the contacts 106 are not in contact with the circuit board 64, the controller 11 cannot access the circuit board 64.

If the controller 11 cannot access the circuit board 64 (S10: NO), in S20 the controller 11 determines that the ink cartridge 30 is not mounted in the cartridge-attachment section 110. In this case, the controller 11 notifies the user that an ink cartridge 30 is not mounted by displaying a message on a display panel (not shown) provided on a housing of the printer 10 and/or emitting a beep or other sound from a speaker (not shown).

However, if the controller 11 can access the circuit board 64 (S10: YES), in S30 the controller 11 then determines whether the signal outputted from the optical sensor 113 is high level or low level. When the light-blocking plate 67 is positioned between the light-emitting portion and light-receiving portion of the optical sensor 113, the optical sensor 113 outputs a low level signal to the controller 11. When the light-blocking plate 67 is not positioned between the light-emitting portion and light-receiving portion of the optical sensor 113, the optical sensor 113 outputs a high level signal to the controller 11.

If the signal outputted from the optical sensor 113 to the controller 11 is the high level (S30: HIGH), in S40 the controller 11 determines that an abnormal ink cartridge 30 is mounted in the cartridge-attachment section 110. In this case, the controller 11 notifies the user that an abnormal ink cartridge 30 is mounted by displaying a message on the display panel (not shown) provided on the housing of the printer 10 and/or plays a beep or other sound from the speaker (not shown).

On the other hand, if the signal outputted by the optical sensor 113 is the low level (S30: LOW), in S50 the controller 11 determines that a normal ink cartridge 30 is mounted in the cartridge-attachment section 110.

In the flowchart of FIG. 9, the controller 11 determines whether an ink cartridge 30 is mounted in the cartridge-attachment section 110 based on whether the circuit board 64 is accessible, and determines whether the ink cartridge 30 mounted in the cartridge-attachment section 110 is normal based on the level of signal outputted from the optical sensor 113.

However, the controller 11 may be configured to determine whether an ink cartridge 30 is mounted in the cartridge-attachment section 110 based on the level of the signal outputted from the optical sensor 113, and to determine whether the ink cartridge 30 mounted in the cartridge-attachment section 110 is normal based on whether the circuit board 64 is accessible. Steps in this variation will be described next with reference to the flowchart in FIG. 10.

Referring to FIG. 10, in S110 the controller 11 determines whether the signal outputted by the optical sensor 113 to the controller 11 is the high level or low level.

If the signal outputted by the optical sensor 113 is the high level (S110: HIGH), in S120 the controller 11 determines that an ink cartridge 30 is not mounted in the cartridge-attachment section 110. In this case, as in S20 of FIG. 9, the controller 11 notifies the user that an ink cartridge 30 is not mounted.

However, if the signal outputted by the optical sensor 113 is the low level (S110: LOW), in S130 the controller 11 determines whether the circuit board 64 of the ink cartridge 30 is accessible.

If the controller 11 cannot access the circuit board 64 (S130: NO), in S140 the controller 11 determines that an abnormal ink cartridge 30 is mounted in the cartridge-attachment section 110. In this case, as in S40 of FIG. 9, the controller 11 notifies the user that an abnormal ink cartridge 30 is mounted.

On the other hand, if the controller 11 can access the circuit board 64 (S130: YES), in S150 the controller 11 determines that a normal ink cartridge 30 is mounted in the cartridge-attachment section 110.

[Operational and Technical Advantages of the First Embodiment]

According to the present embodiment, the circuit board 64 can be positioned vertically by placing the protruding portion 115 of the cartridge-attachment section 110 in contact with the inner top surface 133.

Further, the second opening 137 is formed continuously with the first opening 136 in the first embodiment. Accordingly, the protruding portion 115 of the cartridge-attachment section 110 can access (enter) the receiving space (space beneath the inner top surface 133) from the left and front sides thereof (in the front-rear direction and in the left-right direction) in order to support the movable member 130. Hence, even when the circuit board 64 is arranged rearward far away from the front edge of the ink cartridge 30 as in the structure of the embodiment, the protruding portion 115 can be received in the recessed portion 132 without being hindered by the ink cartridge 30 in order to gain access to a position near the circuit board 64 as the ink cartridge 30 is being inserted into the cartridge-attachment section 110 in the frontward direction 51. In this way, the protruding portion 115 can support the movable member 130 at a position near the circuit board 64 regardless of the position at which the circuit board 64 is arranged. Hence, this arrangement of the embodiment can enhance flexibility in positioning the circuit board 64.

In a state where the ink cartridge 30 of the embodiment is in the upright posture, the inner top surface 133 is positioned above the imaginary plane P1 passing through the top edge 36T of the interior space in the ink cartridge 30, as illustrated in FIG. 6. This arrangement can prevent the presence of the inner top surface 133 from reducing the capacity of the interior space in the ink cartridge 30. In other words, this arrangement avoids a reduction in the quantity of liquid that the ink cartridge 30 can store.

When the ink cartridge 30 is inserted into the cartridge-attachment section 110, the contacts 106 of the cartridge-attachment section 110 are at the same position in the left-right direction as the circuit board 64. According to the depicted embodiment, at least a portion of the inner top surface 133 is at a different position from the circuit board 64 in the left-right direction. Therefore, the movable member 130 can be supported by the cartridge-attachment section 110 (protruding portion 115) at a position in the left-right direction that differs from the left-right position of the circuit board 64. This configuration prevents the protruding portion 115 (i.e., the structure for supporting the movable member 130) from hindering movement of the contacts 106 relative to the ink cartridge 30 during the insertion of the ink cartridge 30 into the cartridge-attachment section 110.

In the embodiment, in the attached state, the distance L1 in the front-rear direction between the position at which the protruding portion 115 contacts the inner top surface 133 (imaginary plane R1) and the circuit board 64 is shorter than the distance L2 in the front-rear direction between the position at which the protruding portion 115 contacts the inner top surface 133 (imaginary plane R1) and the ink supply port 71, as illustrated in FIG. 3. Accordingly, the cartridge-attachment section 110 can support the movable member 130 at a position near the circuit board 64, thereby providing accurate positioning of the circuit board 64.

In the depicted embodiment, the inner top surface 133 does not protrude farther leftward than the side wall 38. Therefore, this configuration avoids an increase in the left-right dimension of the ink cartridge 30.

In the first embodiment, the inner top surface 133 is positioned lower than the imaginary plane P2 passing through the top edge 67T of the light-blocking plate 67, as illustrated in FIG. 6. This configuration can prevent the inner top surface 133, and the protruding portion 115 (i.e., parts that contact the inner top surface 133 to support the movable member 130) from interfering with light irradiated toward the light-blocking plate 67. Further, positioning the inner top surface 133 below the imaginary plane P2 passing through the top edge 67T of the light-blocking plate 67 allows for a shorter vertical dimension of the ink cartridge 30 than otherwise.

During the attached state, the circuit board 64 is supported from below by the protruding portion 115 and contacted from above by the contacts 106. This configuration can provide vertical positioning of the circuit board 64 with greater accuracy.

By providing the sloped surface 138 in front of the inner top surface 133, a vertical dimension of the first opening 136 can be enlarged to facilitate entry of the protruding portion 115 into the receiving space (space beneath the inner top surface 133) in the front-rear direction through the first opening 136. Further, as the ink cartridge 30 is inserted into the cartridge-attachment section 110, the protruding portion 115 contacts the sloped surface 138 so that the sloped surface 138 can guide the protruding portion 115 smoothly into the recessed portion 132.

When the ink cartridge 30 is in its attached state in the cartridge-attachment section 110, the circuit board 64 receives a downward urging force from the corresponding contacts 106. Further, the inner top surface 133 extends further rearward than the electrodes 65. Hence, the protruding portion 115 of the cartridge-attachment section 110 can contact the inner top surface 133 from below and at a position directly beneath the electrodes 65 in order to support the movable member 130. With this configuration, the cartridge-attachment section 110 can receive the downward urging force from the contacts 106 directly through the protruding portion 115 in contact with the inner top surface 133 located beneath the contacts 106, and can thereby support the movable member 130 stably.

In the depicted embodiment, the protruding portion 115 protrudes from the side surface 114B and not from the side surface 114A. Therefore, there is no need to provide the ink cartridge 30 with a recessed portion 132 in a region that confronts the side surface 114A in the attached state. Hence, parts other than the recessed portion 132 may be formed or arranged in this region.

In the embodiment, the inner top surface 133 is positioned below the contacts 106 in the attached state of the ink cartridge 30. Accordingly, this arrangement of the embodiment can prevent the inner top surface 133 from hindering movement of the contacts 106 relative to the ink cartridge 30 during the insertion of the ink cartridge 30 into the cartridge-attachment section 110. Further, the vertical dimension of the ink cartridge 30 can be shortened by a distance by which the inner top surface 133 is positioned below the contacts 106.

[Second Embodiment]

In the first embodiment described above, the ink cartridge 30 is inserted horizontally relative to the cartridge-attachment section 110. The ink cartridge 30 is retained in its attached state in the cartridge-attachment section 110 by the sliding resistance generated between the ink needle 102 inserted into the ink supply port 71 and the inner circumferential surface of the packing 76.

However, the direction in which the ink cartridge 30 is inserted and the means for retaining the ink cartridge 30 in its attached state are not limited to the example in the first embodiment. In other words, the directions in which the ink cartridge 30 is inserted into and removed from the cartridge-attachment section 110 are not limited to the forward and rearward directions. Further, the means for retaining the ink cartridge 30 in the attached state are not limited to the sliding friction between the ink needle 102 inserted in the ink supply port 71 and the inner circumferential surface of the packing 76.

For example, the ink cartridge 30 may be retained in the attached state by pivoting the ink cartridge 30 inside the cartridge-attachment section 110 until the ink cartridge 30 becomes engaged with the cartridge-attachment section 110. Next, a second embodiment of the present disclosure will be described with reference to FIGS. 11 and 12. In the following description, points of difference from the first embodiment will be described in detail, while common points with the first embodiment will be simplified or omitted.

A cartridge-attachment section 210 of the second embodiment further includes four rods 125 and a lock shaft 145, in addition to the parts of the cartridge-attachment section 110. Four kinds of ink cartridges 230 according to the second embodiment corresponding to four colors of ink are insertable into and removable from the cartridge-attachment section 210.

Figure 11:
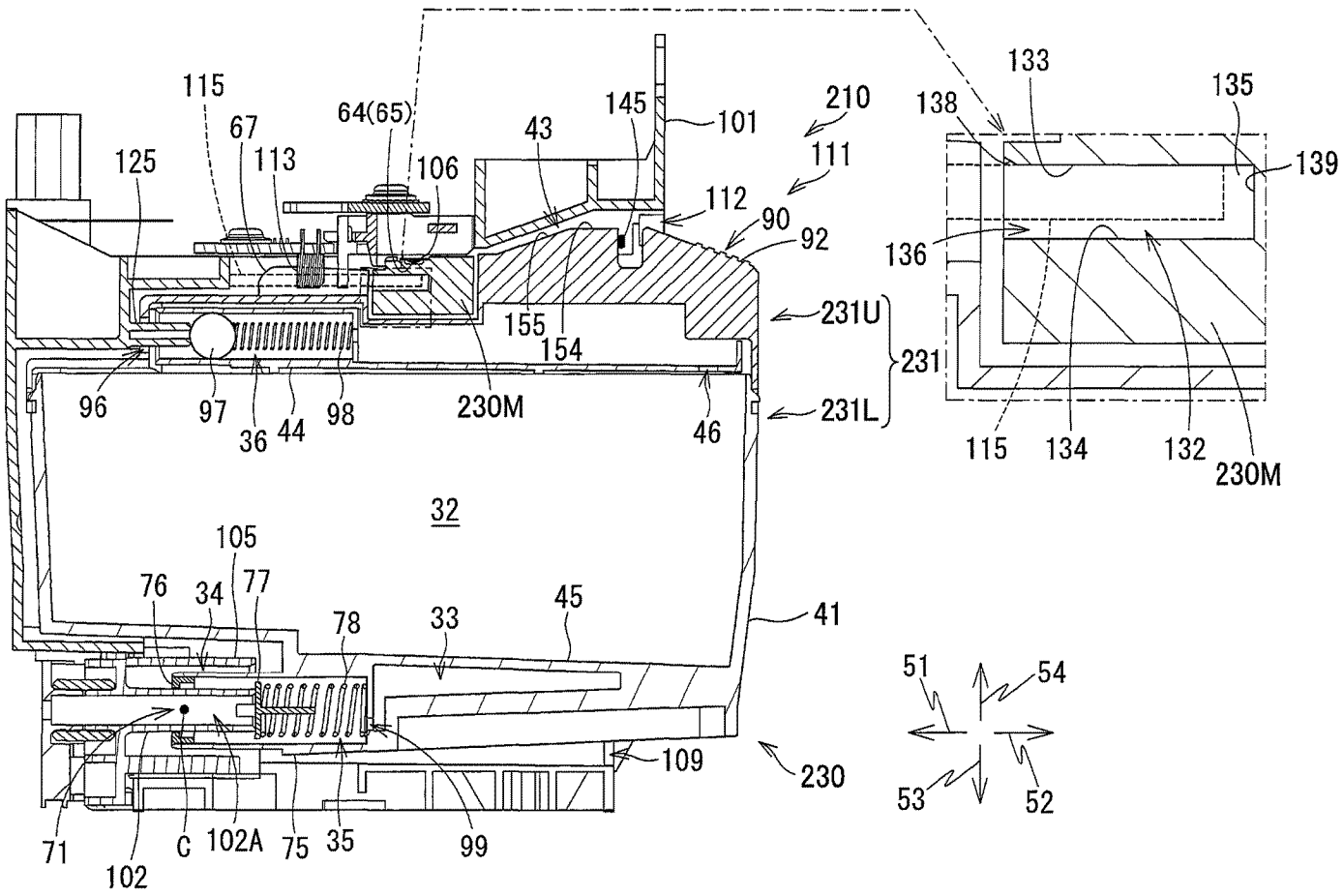
FIG. 11 is a vertical cross-sectional view of a cartridge-attachment section according to a second embodiment in a state where an ink cartridge according to the second embodiment is in an upright posture and attached to the cartridge-attachment section.
Figure 12:
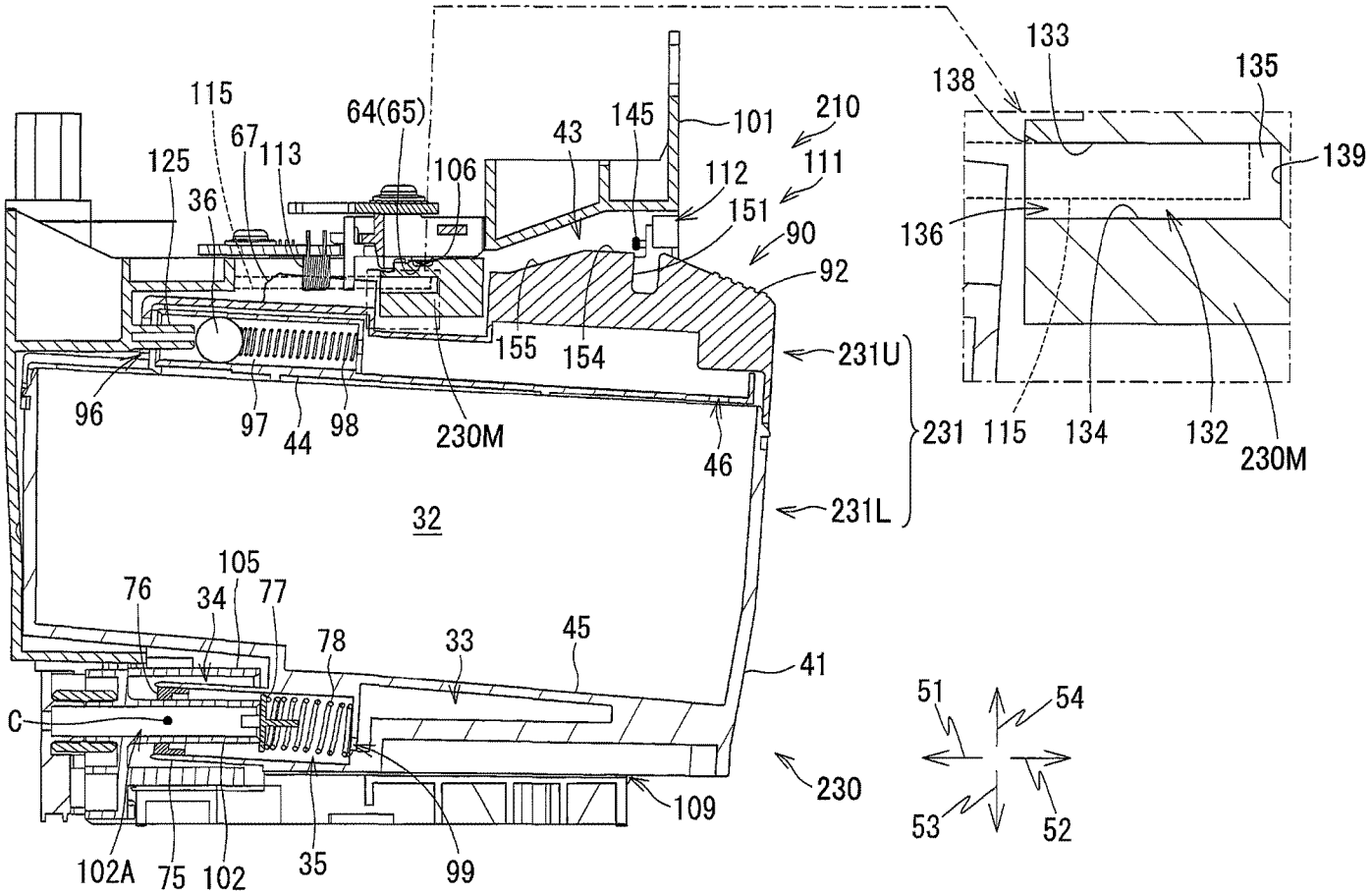
FIG. 12 is a vertical cross-sectional view of the cartridge-attachment section according to the second embodiment in a state where the ink cartridge according to the second embodiment is in an inclined posture and not yet attached to the cartridge-attachment section.

As illustrated in FIGS. 11 and 12, each of the rods 125 is provided at the end wall of the case 101 at a position upward of the corresponding ink needle 102 for each insertion space 111. Each rod 125 is positioned frontward of the corresponding optical sensor 113. The rods 125 are cylindrical in shape and protrude rearward from the end wall of the cartridge case 101. In a state where the ink cartridge 230 is accommodated in the cartridge-attachment section 210, that is, when the ink cartridge 230 is in the attached posture, the rod 125 is received in the air communication port 96 of the ink cartridge 230.

The lock shaft 145 extends in the left-right direction at a position near the top wall and the opening 112 of the case 101. The lock shaft 145 is disposed rearward of the four sets of contacts 106. The lock shaft 145 is a rod-like member and elongated in the left-right direction. For example, the lock shaft 145 is a columnar-shaped metal. The lock shaft 145 has both ends fixed to the walls defining both ends of the case 101 in the left-right direction. Accordingly, the lock shaft 145 does not pivot or otherwise move relative to the case 101. The lock shaft 145 extends in the left-right direction across the four accommodation spaces 111 respectively corresponding to the four ink cartridges 230. Space is also provided around the locking shaft 145 in each of the accommodation spaces 111 that accommodates the ink cartridges 230. Thus, a locking surface 151 (described later) of each ink cartridge 230 can access the lock shaft 145 by moving upward or rearward.

The lock shaft 145 functions to maintain the ink cartridges 230 attached to the cartridge-attachment section 110 in the attached state. As the user inserts the ink cartridge 230 into the cartridge-attachment section 210 and pivots the ink cartridge 230 from an inclined posture shown in FIG. 12 into the upright posture to be used thereby shown in FIG. 11, the ink cartridge 230 engages with the lock shaft 145. Through this operation, the locking shaft 145 retains the ink cartridge 230 in the cartridge-attachment section 210 against the urging force of coil springs 78 and 98 (described later) provided in the ink cartridge 230 for pushing the ink cartridge 230 rearward.

The ink cartridge 230 of the second embodiment includes a casing 231 configured of a lower case 231L and an upper cover 231U, and a movable member 230M.

The lower case 231L corresponds to the casing 31 of the ink cartridge 30 of the first embodiment. The lower case 231L defines therein the first storage chamber 32 and the second storage chamber 33 for storing ink.

The upper cover 231U is positioned above the lower case 231L. The upper cover 231U is fitted onto the lower case 231L. That is, unlike the first embodiment, the upper cover 231U is fixed to the 231*l* and does not move relative to the lower case 231L.

The movable member 230M is supported by the upper cover 231U so as to be movable vertically (upward and downward) relative to the upper cover 231U. That is, the movable member 230M of the second embodiment is different from the movable member 130 of the first embodiment in that: the movable member 230M of the second embodiment is movably supported by the immovable upper cover 231U that is fixed to the lower case 231L, while the movable member 130 as a whole serves as a movable upper cover that is supported by the casing 31 (corresponding to the lower case 231L) in the first embodiment. When an external force is not being applied to the movable member 230M, the movable member 230M moves downward by its own weight and is supported on the upper cover 231U.

The IC board 64 is supported on a top surface of the movable member 230M, as in the first embodiment. The IC board 64 faces upward in the upright posture of the ink cartridge 230.

The ink cartridge 230 also includes a protruding portion 43 and an operation portion 90 both provided on the top wall 39 of the casing 31.

The protruding portion 43 extends in the front-rear direction. The protruding portion 43 has a locking surface 151 that faces rearward in the upright posture. The locking surface 151 is positioned above the top wall 39. The locking surface 151 extends in the vertical direction. The locking surface 151 is arranged to contact the lock shaft 145 from its rear side when the ink cartridge 230 is mounted in the cartridge-attachment section 110. Contact between the locking surface 151 and lock shaft 145, i.e., the engagement of the locking surface 151 and lock shaft 145, holds the ink cartridge 230 in the cartridge-attachment section 110 against the urging force of the coil springs 78 and 98.

Note that, while the locking surface 151 is a vertical surface that extending in a direction crossing the front-rear direction (insertion direction) in the upright posture in the second embodiment, the locking surface 151 may extend horizontally in the front-rear direction and may contact the locking shaft 145 from below in the attached state. In this case, frictional force needs to be generated between the lock shaft 145 and the locking surface 151 to counter the urging force of the coil springs 78 and 98. As long as this frictional force is sufficient to retain the ink cartridge 230 in the cartridge-attachment section 210, the locking surface 151 may be configured of a horizontal surface.

The protruding portion 43 also includes a horizontal surface 154 that extends continuously forward from the locking surface 151. The horizontal surface 154 extends in both the left-right and front-rear directions. The protruding portion 43 also includes an inclined surface 155 that slopes continuously downward and forward from the horizontal surface 154. The inclined surface 155 preferably slopes at an angle of 15° to 25° to the horizontal direction. Since the locking surface 151 and inclined surface 155 are connected via the horizontal surface 154, the boundary between the locking surface 151 and inclined surface 155 is not formed as a sharp angle. The inclined surface 155 is positioned between the locking surface 151 and the circuit board 64 in the front-rear direction. As the ink cartridge 230 is being inserted into the cartridge-attachment section 210, the lock shaft 145 contacts the inclined surface 155 and horizontal surface 154 and is smoothly guided by the inclined surface 155 and horizontal surface 154 to a position rearward of the locking surface 151.

The operation portion 90 is disposed on the top wall 39 to the rear of the locking surface 151. The operation portion 90 has an operation surface 92 facing obliquely upward and rearward in the upright posture. On the operation surface 92, a plurality of ribs is formed to be spaced apart from each other in the front-rear direction. These ribs help the user to visually recognize the operation surface 92, and also prevent user's fingers from slipping over the operation surface 92 to facilitate user's manipulation of the operation surface 92.

The operation surface 92 is visible when viewing the ink cartridge 230 from above and when viewing the ink cartridge 230 from the rear. When the ink cartridge 230 is retained in its attached state in the cartridge-attachment section 210, the user operates the operation surface 92 to remove the ink cartridge 230 from the cartridge-attachment section 210.

The air communication chamber 36 accommodates a valve 97 and the coil spring 98. The air communication chamber 36 communicates with the outside of the ink cartridge 230 through the air communication port 96 formed in an upper portion of a front wall constituting the upper cover 231U. The air communication port 96 has an inner diameter that is larger than an outer diameter of the corresponding rod 125 provided in the cartridge-attachment section 210. The valve 97 is movable between a closed position for sealing the air communication port 96, and an open position separated from the air communication port 96. The coil spring 98 is oriented to be compressible in the front-rear direction and urges the valve 97 forward, i.e., in the direction for contacting the air communication port 96. The coil spring 98 has a spring constant that is smaller than the spring constant of the coil spring 78 disposed in the ink supply portion 34.

During the insertion of the ink cartridge 230 into the cartridge-attachment section 210, the corresponding rod 125 is inserted through the air communication port 96. The rod 125 inserted through the air communication port 96 moves the valve 97 sealing the air communication port 96 rearward against the urging force of the coil spring 98. When the valve 97 moves rearward and separates from the air communication port 96, the first storage chamber 32 is opened to the atmosphere.

Hereinafter, a method for attaching the ink cartridge 230 to the cartridge-attachment section 210 will be described.

In the ink cartridge 230 prior to attachment to the cartridge-attachment section 210, the valve 77 closes the ink supply port 71 of the packing 76. Accordingly, at this time, ink flow to the outside of the ink cartridge 230 is interrupted. Further, in this state, the valve 97 closes the air communication port 96. The first ink chamber 32 is thus not opened to the atmosphere.

For attaching the ink cartridge 230 to the cartridge-attachment section 210, the ink cartridge 230 is configured to be inserted into the case 101 in the upright posture through the opening 112 of the cartridge-attachment section 210. As in the first embodiment, the user pushes the upper portion 41U of the rear wall 41 forward to insert the ink cartridge 230 into the cartridge-attachment section 210. The bottom portion of the ink cartridge 230 enters the corresponding guide groove 109 provided in the bottom of the case 101 (see FIG. 2).

As the ink cartridge 230 is inserted into the case 101, the ink supply portion 34 advances into the corresponding guide portion 105, as illustrated in FIG. 12. At the same time, the rod 125 also advances into the corresponding air communication port 96.

Further, at this time, the protruding portion 115 enters into the receiving space of the recessed portion 132 of the movable member 230M. As in the first embodiment, the protruding portion 115 advances into the receiving space of the recessed portion 132 from its front side toward the rear end of the recessed portion 132, i.e., toward the inner rear surface 139 of the recessed portion 132.

As the ink cartridge 230 is inserted further frontward near the end wall of the case 101, the corresponding ink needle 102 enters inside the ink valve chamber 35 through the ink supply port 71, forcing the valve 77 to separate from the packing 76 against the urging force of the coil spring 78. As a result, the ink needle 102 is connected to the ink valve chamber 35 and the ink supply portion 34 is fixed relative to the cartridge-attachment section 210. The ink stored in the ink valve chamber 35 is allowed to flow into the interior space 102A of the ink needle 102. Further, the rod 125 having entered into the air communication port 96 abuts on the valve 97, forcing the valve 97 to separate from the air communication port 96 against the urging force of the coil spring 98. As a result, the first ink chamber 32 is opened to the atmosphere through the through-hole 46, the air communication chamber 36, and the air communication port 96.

Also, in this state, the ink cartridge 230 as a whole is applied with the rearward urging force generated by the coil springs 78 and 98. The magnitude of the urging force generated by each of the coil springs 78 and 98 is determined by the spring constant of the spring and the distance of the spring that is compressed from its natural length. The spring constant of the coil spring 98 is smaller than the spring constant of the coil spring 78. The compressed distance of the coil spring 78 (a distance by which the valve 77 is separated from the ink supply port 71) is greater than the compressed distance of the coil spring 98 (a distance by which the valve 97 is separated from the air communication port 96). As a result, the magnitude of the urging force generated by the coil spring 78 is greater than the magnitude of the urging force generated by the coil spring 98.

Meanwhile, the protruding portion 43 reaches the lock shaft 145, and the inclined surface 155 slides against the lock shaft 145. Since the user holds the upper portion 41U of the rear wall 41 and continues to push the ink cartridge 230 forward, the ink cartridge 230 is applied with a rotational moment acting in a counterclockwise direction in FIG. 12. However, due to the contact between the inclined surface 155 and lock shaft 145, the ink cartridge 230 is pivoted clockwise in FIG. 12 about a pivot center C, against this counterclockwise rotational moment. This pivot center C (depicted in FIGS. 11 and 12) is provided by a center of the ink supply port 71 of the packing 76 into which the corresponding ink needle 102 is inserted.

This position of the pivot center C in the ink cartridge 230 depends on the shape of the ink needle 102 and the shape of the ink supply port 71, but the center of an area in which the ink needle 102 contacts the inner surface of the cylindrical ink supply portion 34 is the hypothetical pivot center. In the second embodiment, the hypothetical pivot center C is the center of a portion of the ink needle 102 that contacts the inner circumferential surface of the packing 76 defining the ink supply port 71. The ink cartridge 230 of the second embodiment pivots clockwise about this pivot center C. The posture (orientation) of the ink cartridge 230 at this point (the posture of the ink cartridge 230 shown in FIG. 12) will be called the inclined posture.

Also, since the bottom wall 42 of the lower case 231L is inclined relative to the front-rear direction (insertion direction), a space is available between the bottom wall 42 and the bottom surface of the guide groove 109 of the case 101. This space allows the above-described pivotal movement of the ink cartridge 230 in the clockwise direction.

Further, since the inner diameter of the air communication port 96 is larger than the outer diameter of the rod 125, a space is also provided between the rod 125 and the air communication port 96. This space also allows the pivotal movement of the ink cartridge 230 in the clockwise direction. In other words, in the state where the ink cartridge 230 is attached to the cartridge-attachment section 210, the rod 125 and the air communication port 96 do not contact with each other. That is, vertical positioning is not performed between the rod 125 and the air communication port 96.

As the ink cartridge 230 is further inserted forward against the urging forces of the coil springs 78 and 98, the inclined surface 155 and the horizontal surface 154 of the protruding portion 43 become positioned closer to the end wall of the case 101 than the lock shaft 145 is to the end wall. At this time, as illustrated in FIG. 12, in the ink cartridge 230 in the inclined posture, the locking surface 151 is positioned below the lock shaft 145.

At this time, the protruding portion 115 entered into the receiving space of the recessed portion 132 is received by the recessed portion 132, making contact with the inner top surface 133 of the recessed portion 132 to move the movable member 230M upward relative to the upper cover 231U, as illustrated in FIG. 12.

Also, while the ink cartridge 230 is in the inclined posture, the IC board 64 becomes positioned below the corresponding contacts 106. As a result of the upward movement of the movable member 230M by the protruding portion 115 received in the receiving space of the recessed portion 132, the IC board 64 is brought into contact with the corresponding contacts 106 of the cartridge-attachment section 210. An electrical connection is therefore established between the electrodes 65 on the IC board 64 and the contacts 106.

Further, the light-blocking plate 67 is positioned between the light-emitting portion and light-receiving portion of the corresponding optical sensor 113. Accordingly, the light-blocking plate 67 blocks the passage of light from the light-emitting portion to the light-receiving portion, as in the first embodiment described above.

As the user continues to push forward on the upper portion 41U of the rear wall 41, the rotational moment is applied to the ink cartridge 230 in the counterclockwise direction in FIG. 12. At the same time, rotational moment acting in the clockwise direction is also generated in the ink cartridge 230 by the urging force of the coil spring 98 provided in the air valve chamber 36. Since the inclined surface 155 and horizontal surface 154 no longer contact the lock shaft 145, the force applied by the user pivots the ink cartridge 230 in the counterclockwise direction in FIG. 12 about the pivot center C of the ink supply port 71 in which the ink needle 102 is inserted and against the urging force of the coil spring 98. As a result, the ink cartridge 230 moves to the upright posture shown in FIG. 11.

As the ink cartridge 230 is pivoted counterclockwise from the state shown in FIG. 12, the locking surface 151 faces rearward and opposes the lock shaft 145 in the front-rear direction. When the user stops pushing the ink cartridge 230 frontward, the ink cartridge 230 is moved rearward by the urging force of the coil spring 78. The locking surface 151 therefore moves rearward and abuts against the lock shaft 145 from frontward thereof, thereby restricting the ink cartridge 230 from moving further rearward. The ink cartridge 230 is thus fixed in position relative to the cartridge-attachment section 210 by the abutment (engagement) between the locking surface 151 and the lock shaft 145. Attachment of the ink cartridge 230 to the cartridge-attachment section 210 is thus complete (in its attached state) as shown in FIG. 11. At this time, the ink cartridge 230 is in the upright posture.

In this way, the ink cartridge 230 is pivotable about the pivot center C to move between the upright posture and the inclined posture in the cartridge-attachment section 110.

In the second embodiment, the "insertion of the ink cartridge 30" is deemed to be completed when the ink cartridge 230 is fixed in position relative to the cartridge-attachment section 210, with the locking surface 151 engaged with the lock shaft 145. That is, the "insertion of the ink cartridge 30" is not deemed to end simply because the ink needle 102 is inserted into the ink supply portion 34.

In the attached state of the ink cartridge 230 (in the upright posture), the protruding portion 115 of the cartridge-attachment section 210 contacts the inner top surface 133 of the movable member 230M from below and supports the movable member 230M.

Further, in the attached state, the electrodes 65 of the circuit board 64 contact the corresponding contacts 106 from below. That is, the electrodes 65 resiliently deform the contacts 106 upward, forming electrical connection with the same. While the resilient deformation of the contacts 106 urges the circuit board 64 downward at this time, the ink cartridge 230 is retained by the protruding portion 115 supporting the movable member 230M. Consequently, the circuit board 64 maintains the resilient deformation of the contacts 106.

When removing the ink cartridge 230 from the cartridge-attachment section 210, the user presses down on the operation surface 92. When the ink cartridge 230 is in the upright posture, the operation surface 92 faces diagonally upward and rearward. Therefore, when the user operates the operation surface 92, a force acting in a direction diagonally downward and forward is applied to the ink cartridge 230. This force pivots the ink cartridge 230 clockwise in FIG. 11, thereby moving the locking surface 151 to a position lower than the lock shaft 145. In other words, the ink cartridge 230 shifts from the upright posture to the inclined posture. At this time, the urging force of the coil spring 78 moves the ink cartridge 230 rearward relative to the cartridge-attachment section 210, and the user can extract the ink cartridge 230 from the cartridge-attachment section 210.

According to the second embodiment, the locking surface 151 is positioned farther rearward than the circuit board 64 in the front-rear direction. This arrangement can prevent the locking surface 151 from impeding insertion of the ink cartridge 230 into the cartridge-attachment section 210. For example, this arrangement can prevent the locking surface 151 from impeding movement of the contacts 106 provided in the cartridge-attachment section 210 relative to the ink cartridge 230.

Note that, in the second embodiment, the IC board 64 on the movable member 230M may contact the contacts 106 to be electrically connected thereto before or after the movable member 230M is lifted up by the protruding portion 115 received in the receiving space of the recessed portion 132.

[Variations and Modifications]

In the following, various modifications to the depicted embodiments will be described. Like parts and components will be designated with the same reference numerals as those of the depicted embodiments to avoid duplicating explanation.

In the first and second embodiments, the protruding portion 115 protrudes rightward from the side surface 114B, but the protruding portion 115 may instead protrude leftward from the side surface 114A. Further, while the protruding portion 115 protrudes from only one of the side surfaces 114A and 114B in the first and second embodiments (only the side surface 114B), two protruding portions 115 may be provided with one protruding rightward from the side surface 114B and another one protruding leftward from the side surface 114A.

Specifically, as depicted in FIG. 8B, a cartridge-attachment section 310 according to a variation of the first embodiment includes a case 301 provided with two protruding portions 115 with one protruding rightward from the side surface 114B and another one protruding leftward from the side surface 114A. An ink cartridge 330 according to this variation includes a movable member 330M formed with two recessed portions 132 each adapted to receive corresponding one of the two protruding portions 115. Hence, in this variation, one of the second openings 137 is open leftward on the left side surface 82L of the peripheral wall 82 constituting the movable member 330M, and the other one of the second opening 137 is open rightward on a right side surface 82R of the peripheral wall 82 constituting the movable member 330M.

In the first and second embodiments, the recessed portion 132 is formed in the left side surface of the movable member 130, 230M at a position corresponding to the protruding portion 115 protruding from the side surface 114B. However, the position of the recessed portion 132 may be modified to suit the configuration of the protruding portion 115. For example, when the protruding portion 115 is configured to protrude from the side surface 114A, the recessed portion 132 may be formed in the right side surface of the movable member 130, 230M. Alternatively, if protruding portions 115 protrude from both the side surfaces 114A and 114B, the recessed portion 132 may be formed in both left and right side surfaces of the movable member 130, 230M (as illustrated in the example shown in FIG. 8B).

In the depicted embodiments, the inner top surface 133 defining the top of the recessed portion 132 serves as a surface configured to contact the protruding portion 115 (an example of a contact surface). However, the contact surface is not limited to the inner top surface 133.

Figure 15:
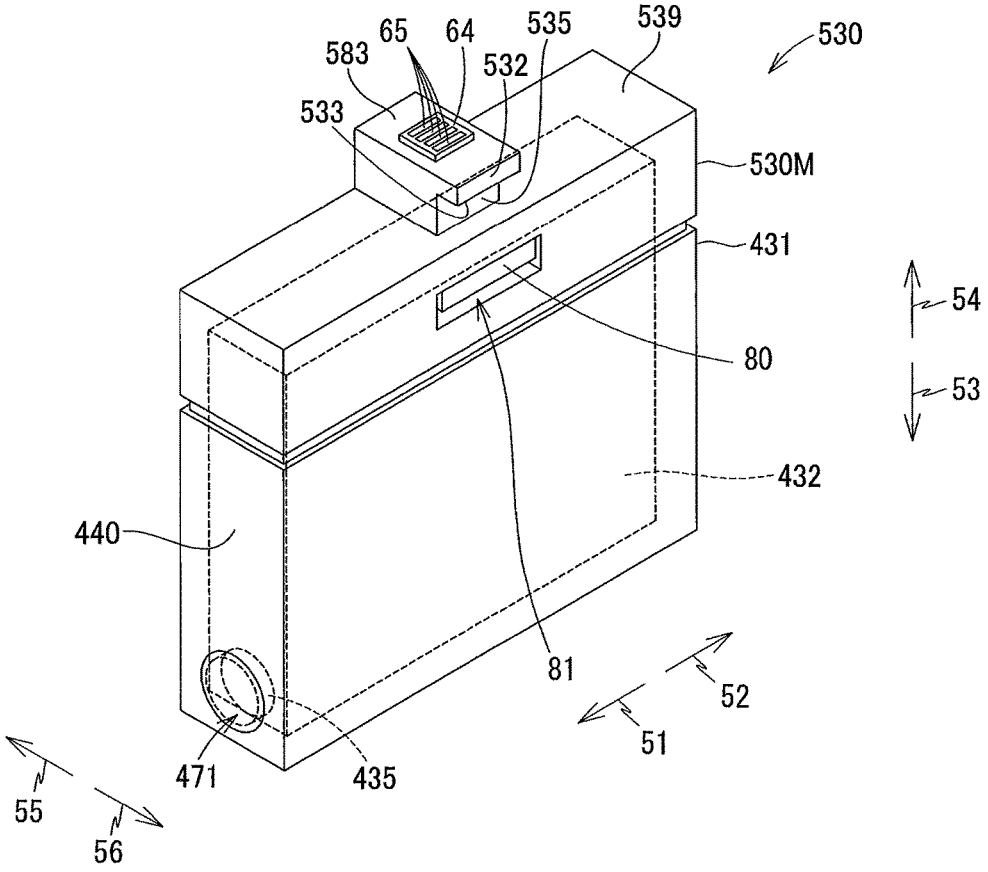
FIG. 15 is a perspective view of an ink cartridge according to a second modification as viewed from its front side.

For example, if the movable member 130, 230M is provided with a protrusion in place of the recessed portion 132 that protrudes leftward from the left side surface thereof, the contact surface may be a bottom surface of the protrusion (see FIG. 15, for example). In case that a bottom surface of a protrusion serves as the contact surface, the bottom surface of the protrusion defines a top of a space for receiving the protruding portion 115. This space below the bottom surface of the protrusion may differ from the space defined by the recessed portion 132 of the embodiments in that: the space of this variation is open on the rear and bottom sides in addition to the front and left sides In other words, as long as the movable member 130, 230M has a surface corresponding to the inner top surface 133 of the depicted embodiments, the movable member 130, 230M need not be provided with surfaces corresponding to the inner bottom surface 134, inner right surface 135 and inner rear surface 139 of the embodiments. Essentially, the movable member 130, 230M need only be provided with following surfaces: a contact surface contacted by the protruding portion 115; a surface supported by the casing 31, 231; and a surface for supporting the circuit board 64 that faces away from the contact surface in the vertical direction.

Figure 13:
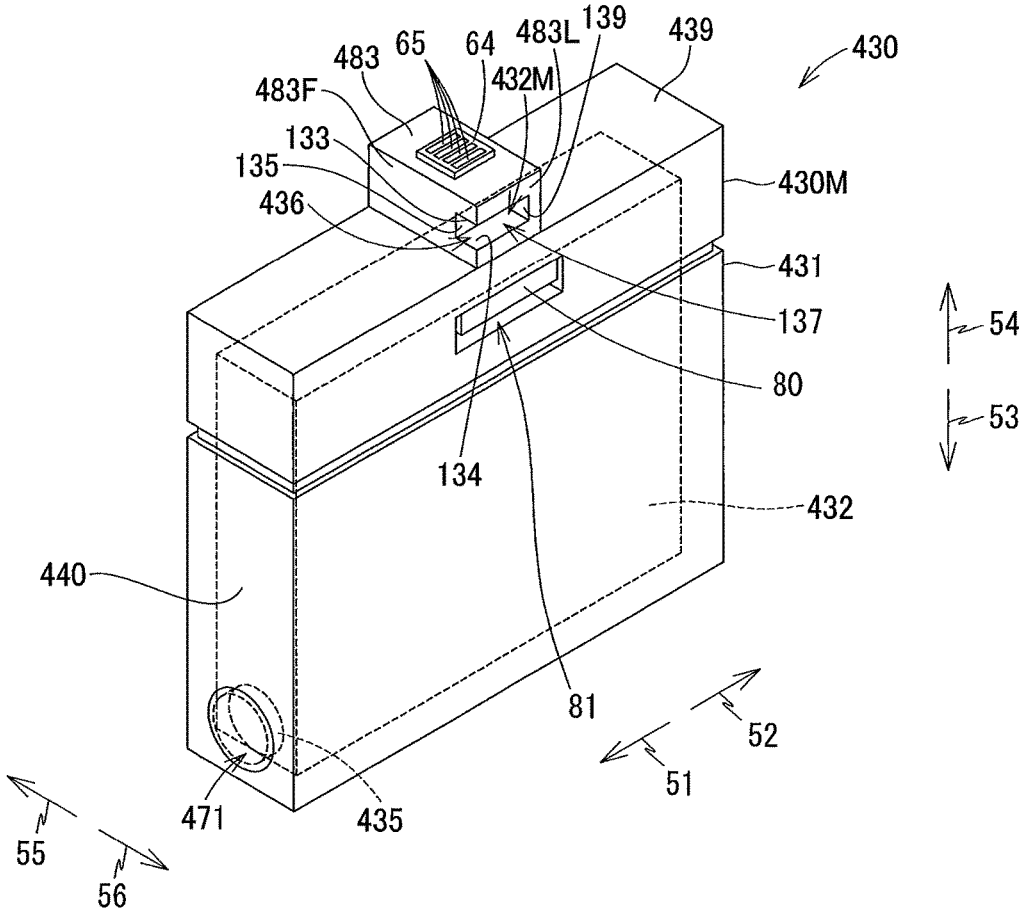
FIG. 13 is a perspective view of an ink cartridge according to a first modification as viewed from its front side.

The ink cartridge 30, 230 is not limited to the structure shown in FIGS. 4 through 6, and FIGS. 11 and 12. As an alternative example, FIG. 13 depicts an ink cartridge 430 according to a first modification to the first and second embodiments. As shown in FIG. 13, the ink cartridge 430 has an outer shape that approximates a rectangular parallelepiped. In this modification, the ink cartridge 430 does not include the light-blocking plate 67, the protruding portion 43, and the operation portion 90.

Specifically, the ink cartridge 430 of the first modification includes a casing 431 defining an ink storage chamber 432 therein, and a movable member 430M movably supported by the casing 431. The casing 431 and movable member 430M are both generally rectangular parallelepiped. The casing 431 includes an ink supply port 471 that is an open end of a through-hole formed in a front wall 440 to penetrate the same in the front-rear direction. An interior space of this through-hole serves as a chamber 435 providing communication between the ink storage chamber 432 and the exterior of the casing 431. The ink supply port 471 is sealed with a seal (shown without a reference numeral in FIG. 13).

The movable member 430M is movable vertically relative to the casing 431, as in the first embodiment. The movable member 430M has an upper wall 439 on which a protruding portion 483 is disposed for supporting the IC board 64. The protruding portion 483 includes a recessed portion 432M.

The recessed portion 432M does not include the sloped surface 138, unlike the recessed portion 132 of the first and second embodiments. That is, the recessed portion 432M only includes the inner top surface 133, inner right surface 135, inner bottom surface 134, and inner rear surface 139 defining a space for receiving the protruding portion 115 (receiving space). Thus, in the first modification, a first opening 436 is defined by the inner top surface 133, inner right surface 135 and inner bottom surface 134. The first opening 436 is open frontward on a front surface 483F of the protruding portion 483 to allow the protruding portion 115 to be received in the recessed portion 432M in the front-rear direction. The second opening 137 is defined by the inner top surface 133, inner bottom surface 134 and inner rear surface 139, as in the first embodiment. The second opening 137 is open on a left side surface 483L of the protruding portion 483.

Figure 14:
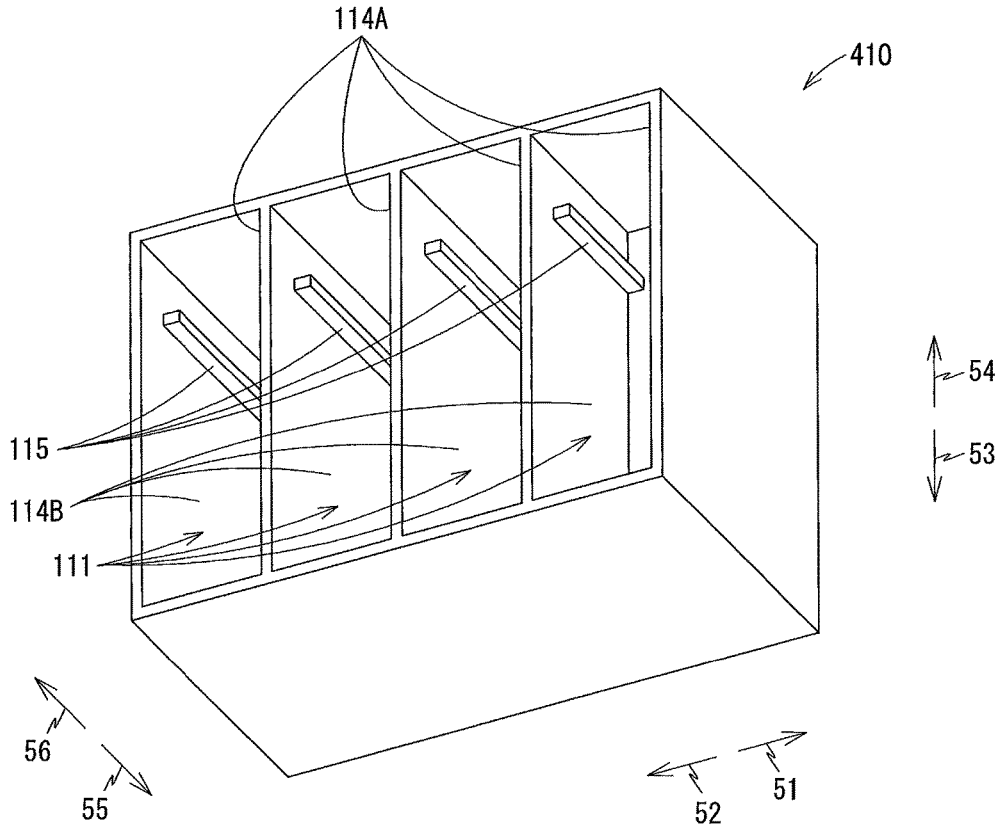
FIG. 14 is a perspective view of a cartridge-attachment section according to the first modification into which the ink cartridge according to the first modification can be inserted.

The ink cartridge 430 according to the first modification is inserted into a cartridge-attachment section 410 shown in FIG. 14 in the front-rear direction without pivotal movement, as in the first embodiment. During the insertion of the ink cartridge 430, the protruding portion 115 advances into the space (receiving space) in the recessed portion 432M through the first opening 136 and through the second opening 137. The protruding portion 115 contacts and pushes the inner top surface 133 upward as the ink cartridge 430 is inserted forward, thereby moving the movable member 430M upward. Note that, the ink cartridge 430 may also be pivoted inside the cartridge-attachment section 410 for attachment, as in the second embodiment.

Further, during the insertion of the ink cartridge 430, the tip end of the ink needle 102 (not shown in FIG. 14) breaks the seal covering the ink supply port 471, passing through the chamber 435 and reaches the ink storage chamber 432. As in the first embodiment, the ink cartridge 430 of the first modification can be retained in its attached state in the cartridge-attachment section 410 by the sliding friction generated between the ink needle 102 (not shown in FIG. 14) inserted in the chamber 435 through the ink supply port 471 and an inner circumferential surface of the front wall 440 defining the chamber 435.

The ink cartridge 430 does not include the coil springs 78 and 98 in the chamber 435. Therefore, the ink cartridge 430 need not be inserted into the cartridge-attachment section 410 against a rearward urging force.

FIG. 15 shows an ink cartridge 530 according to a second modification to the first embodiment. This ink cartridge 530 includes a protrusion 532, instead of the recessed portion 132.

More specifically, the ink cartridge 530 includes the casing 431, and a movable member 530M movably supported by the casing 431. The movable member 530M has an upper wall 539 on which a protruding portion 583 is disposed for supporting the IC board 64. The protruding portion 583 has a left surface 535 from which the protrusion 532 protrudes leftward. In this second modification, a bottom surface 533 of the protrusion 532 is configured to contact the protruding portion 115 of the cartridge-attachment section 410. Since the protrusion 532 is a protrusion, surfaces corresponding to the inner right surface 135, inner bottom surface 134 and inner rear surface 139 are dispensed with. A space (receiving space) for receiving the protruding portion 115 is defined below the bottom surface 533 of the protrusion 532. Specifically, the receiving space of the second modification is defined by the bottom surface 533 and the left surface 535 that is orthogonal to the bottom surface 533. During insertion of the ink cartridge 530 into the cartridge-attachment section 410 and in a state where the ink cartridge 530 is accommodated in the cartridge-attachment section 410, the protruding portion 115 advances into this receiving space below the bottom surface 533 and contacts with the bottom surface 533 of the protrusion 532, thereby moving the movable member 530M upward.

Figure 16:
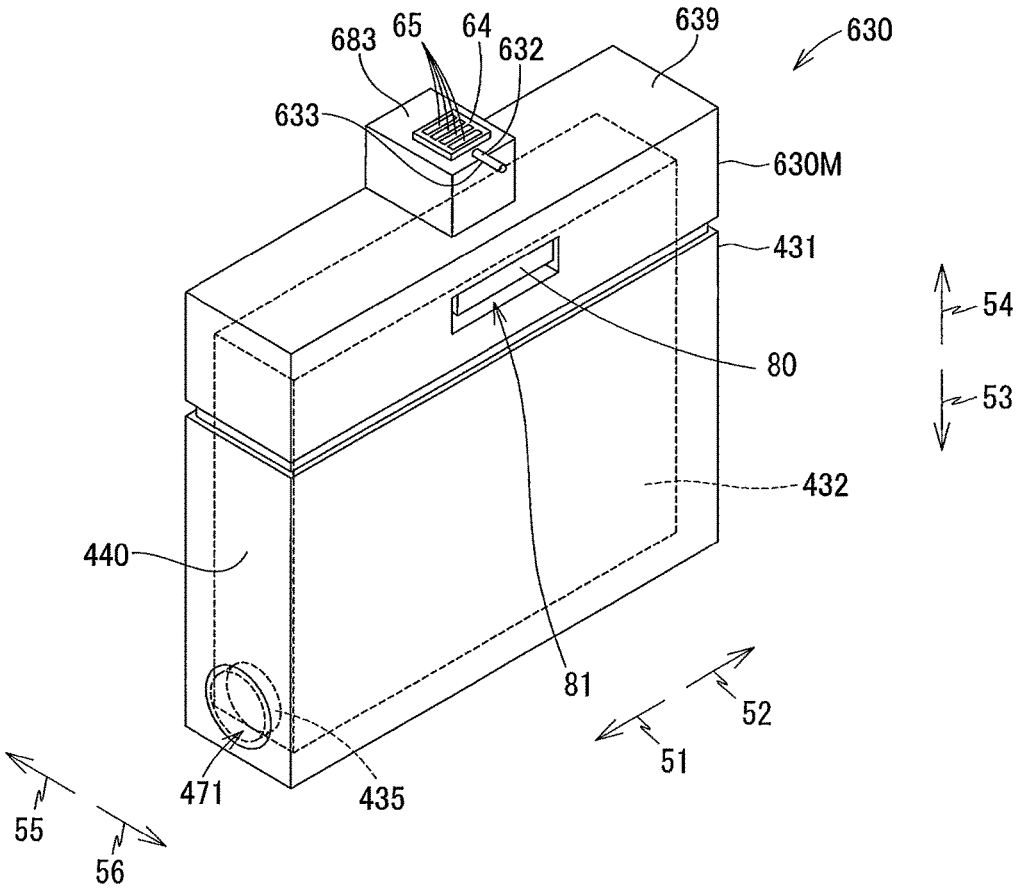
FIG. 16 is a perspective view of an ink cartridge according to a third modification as viewed from its front side.

FIG. 16 shows an ink cartridge 630 according to a third modification to the first embodiment. This ink cartridge 530 includes a rod member 632, instead of the recessed portion 132, for receiving the protruding portion 115.

More specifically, the ink cartridge 630 includes the casing 431, and a movable member 630M movably supported by the casing 431. The movable member 630M has an upper wall 639 on which a protruding portion 683 is disposed for supporting the IC board 64. The rod member 632 is disposed on a top surface of the protruding portion 683 and is oriented in the left-right direction. Specifically, the rod member 632 has a right end fixed on the top surface of the protruding portion 683, and a left end protruding farther leftward than a left surface of the protruding portion 683. In this third modification, a bottom surface 633 of the rod member 632 is configured to contact the protruding portion 115 of the cartridge-attachment section 410. That is, as in the second modification, surfaces corresponding to the inner right surface 135, inner bottom surface 134 and inner rear surface 139 are dispensed with. A space (receiving space) is provided below the bottom surface 633 of the rod member 632 for receiving the protruding portion 115. During insertion of the ink cartridge 630 into the cartridge-attachment section 410 and in a state where the ink cartridge 630 is accommodated in the cartridge-attachment section 410, the protruding portion 115 advances into this receiving space below the bottom surface 633 of the rod member 632 and contacts with the bottom surface 633, thereby lifting the movable member 630M upward.

With these configurations of the modifications, similar technical and operational advantages can be obtained.

The positional relationships of components in the ink cartridge 30, 230 and cartridge-attachment section 110, 210 are also not limited to those described in the depicted embodiments. For example, the inner top surface 133 need not be positioned above the imaginary plane P1 (see FIG. 6) passing through the top edge 36T of the interior space in the ink cartridge 30 (the first storage chamber 32, the second storage chamber 33, and the air communication chamber 36)

when the ink cartridge 30 is in the upright posture. Further, with respect to the left-right direction, the inner top surface 133 may be positioned between the right edge and left edge of the circuit board 64, for example. Further, the distance L1 (see FIG. 3) in the front-rear direction between the position at which the protruding portion 115 contacts the inner top surface 133 and the position of the circuit board 64 may be greater than or equal to the distance L2 in the front-rear direction between the position at which the protruding portion 115 contacts the inner top surface 133 and the ink supply port 71, for example. Still further, the circuit board 64 may also be positioned farther forward than the light-blocking plate 67, for example. Still alternatively, the inner top surface 133 may also be positioned above the imaginary plane P2 (see FIG. 6) that passes through the top edge 67T of the light-blocking plate 67, for example. Further, the circuit board 64 may also be positioned farther forward than the ink needle 102 in the attached state, for example.

Further, while ink serves as an example of liquid in the depicted embodiments, the liquid of the present disclosure is not limited to ink. For example, a pretreatment liquid that is ejected onto sheets prior to ink during a printing operation may be stored in the liquid cartridge. Alternatively, cleaning water for cleaning the recoding head 21 may be stored in the liquid cartridge.

<Remarks>

The liquid cartridges 30, 230, 330, 430, 530 and 630 are an example of a liquid cartridge. The cartridge-attachment sections 110, 210, 310 and 410 are an example of a cartridge-attachment section. The protruding portion 115 is an example of a protruding portion. The cartridge bodies 31, 231, 431 are an example of a casing. The first storage chamber 32, second storage chamber 33 and ink storage chamber 432 are an example of liquid chamber. The ink valve chamber 35 is an example of a liquid passage. The chamber 435 is another example of the liquid passage. The ink supply ports 71 and 471 are an example of a liquid outlet. The movable members 130, 230M, 330M, 430M, 530M and 630M are an example of a movable member. The IC board 64 and electrodes 65 are an example of a circuit board. The recessed portion 132, recessed portion 432M, protrusion 532 and rod member 632 are an example of a receiving portion. The inner top surface 133, bottom surfaces 533 and 633 are an example of a contact surface. The recessed portions 132 and 432M are an example of a recess. The sloped surface 138 is an example of a sloped surface. The inner right surface 135 is an example of a first surface. The inner bottom surface 134 is an example of a second surface. The inner rear surface 139 is an example of a third surface. The first openings 136 and 436 are an example of a first inlet opening. The second opening 137 is an example of a second inlet opening. The left surface 535 is another example of a first surface. The vertical surface 39C and front surface 483F are an example of a front surface. The left side surfaces 82L and 483L are an example of a side surface. The light-blocking plate 67 is an example of a light-blocking portion. The locking surface 151 is an example of an engaging surface. The lock shaft 145 is an example of an engaging portion. The frontward direction 51 is an example of an insertion direction. The rightward direction 55 and leftward direction 56 are an example of a widthwise direction.

What is claimed is:

1. A liquid cartridge configured to be inserted into a cartridge-attachment section in an insertion direction crossing a gravitational direction and accommodated in the cartridge-attachment section in an upright posture, the cartridge-attachment section including a protruding portion extending in the insertion direction and having a width in a widthwise direction orthogonal to the insertion direction and the gravitational direction, the liquid cartridge in the upright posture comprising:

a casing comprising:

a liquid chamber storing liquid therein; and a liquid passage extending from the liquid chamber in the insertion direction;

a movable member movably supported by the casing, the movable member being movable relative to the casing; and a circuit board provided at the movable member and facing upward;

wherein the movable member includes a receiving portion adapted to receive the protruding portion of the cartridge-attachment section in the insertion direction and in the widthwise direction;

wherein the receiving portion provides a receiving space that is open in the insertion direction and in the widthwise direction; and wherein the receiving portion has a contact surface defining the receiving space, the contact surface facing downward and extending in the insertion direction and the widthwise direction, the contact surface being configured to contact the protruding portion of the cartridge-attachment section.

2. The liquid cartridge according to claim 1, wherein the receiving portion further has a sloped surface connected to the contact surface and positioned frontward of the contact surface in the insertion direction in the upright posture, the sloped surface sloping relative to the insertion direction to face diagonally downward and frontward in the upright posture, the sloped surface being configured to guide the protruding portion to enter into the receiving space in the insertion direction.

3. The liquid cartridge according to claim 2, wherein the receiving portion comprises a recess defining the receiving space, the receiving portion further having a first surface extending in the insertion direction and orthogonal to the contact surface in the upright posture, the contact surface and the first surface defining the recess.

4. The liquid cartridge according to claim 3, wherein the receiving portion further comprises a second surface and a third surface both defining the recess together with the contact surface and the first surface, the second surface extending in the insertion direction and orthogonal to the first surface in the upright posture, the third surface extending in the widthwise direction and orthogonal to the contact surface and the first surface and the second surface in the upright posture;

wherein the sloped surface, the first surface and the second surface constitute a first inlet opening; and wherein the contact surface, the second surface and the third surface constitute a second inlet opening, the receiving portion being configured to receive the protruding portion through the first inlet opening and through the second inlet opening into the receiving space during the insertion of the liquid cartridge into the cartridge-attachment section.

5. The liquid cartridge according to claim 4, wherein the casing includes a liquid outlet provided at a front end of the liquid passage in the insertion direction;

wherein the receiving portion further has a front surface and a side surface, the front surface facing frontward in the insertion direction and being positioned rearward relative to the liquid outlet in the insertion direction in the upright posture, the side surface facing away from the receiving space in the widthwise direction and being positioned rearward relative to the liquid outlet in the insertion direction in the upright posture; and wherein the first inlet opening is open on the front surface and the second inlet opening is open on the side surface.

6. The liquid cartridge according to claim 1, wherein the receiving portion comprises a recess defining the receiving space, the receiving portion further having a first surface extending in the insertion direction and orthogonal to the contact surface in the upright posture, the contact surface and the first surface defining the recess.

7. The liquid cartridge according to claim 6, wherein the receiving portion further has a second surface and a third surface both defining the recess together with the contact surface and the first surface, the second surface extending in the insertion direction and orthogonal to the first surface in the upright posture, the third surface extending in the widthwise direction and orthogonal to the contact surface and the first surface and the second surface in the upright posture;

wherein the contact surface, the first surface and the second surface constitute a first inlet opening; and wherein the contact surface, the second surface and the third surface constitute a second inlet opening, the receiving portion being configured to receive the protruding portion through the first inlet opening and through the second inlet opening into the receiving space during the insertion of the liquid cartridge into the cartridge-attachment section.

8. The liquid cartridge according to claim 7, wherein the casing includes a liquid outlet provided at a front end of the liquid passage in the insertion direction;

wherein the receiving portion further has a front surface and a side surface, the front surface facing frontward in the insertion direction and being positioned rearward relative to the liquid outlet in the insertion direction in the upright posture, the side surface facing away from the receiving space in the widthwise direction and being positioned rearward relative to the liquid outlet in the insertion direction in the upright posture; and wherein the first inlet opening is open on the front surface and the second inlet opening is open on the side surface.

9. The liquid cartridge according to claim 1, wherein the contact surface is positioned above the liquid chamber.

10. The liquid cartridge according to claim 1, wherein the contact surface has a region located offset from the circuit board in the widthwise direction in the upright posture.

11. The liquid cartridge according to claim 1, wherein the casing includes a liquid outlet provided at a front end of the liquid passage in the insertion direction; and wherein the contact surface is in contact with the protruding portion at a contact position in the state where the liquid cartridge is accommodated in the cartridge-attachment section, a distance between the contact position and the circuit board in the insertion direction being smaller than a distance between the contact position and the liquid outlet in the insertion direction.

12. The liquid cartridge according to claim 1, wherein the casing comprises:

a front wall at which the liquid passage is provided;

a rear wall positioned away from the front wall in the insertion direction; and a pair of side walls connecting the front wall to the rear wall and defining the liquid chamber, the contact surface having a portion positioned closer to one of the side walls than the circuit board is to the one of the side walls in the widthwise direction.

13. The liquid cartridge according to claim 1, further comprising a light-blocking portion configured to block or attenuate light traveling in the widthwise direction in the upright posture in the state where the liquid cartridge is accommodated in the cartridge-attachment section, the circuit board being positioned rearward relative to the light-blocking portion in the insertion direction in the upright posture.

14. The liquid cartridge according to claim 13, wherein the contact surface is positioned below an upper end of the light-blocking portion in the upright posture.

15. The liquid cartridge according to claim 1, the liquid cartridge being inserted into the cartridge-attachment section against an urging force acting in a direction opposite to the insertion direction, wherein the casing further has an engaging surface configured to engage an engaging portion provided at the cartridge-attachment section in the state where the liquid cartridge is accommodated in the cartridge-attachment section;

wherein the circuit board is positioned frontward relative to the engaging surface in the insertion direction in the upright posture; and wherein the liquid cartridge is movable between the upright posture and an inclined posture relative to the cartridge-attachment section during the insertion of the liquid cartridge into the cartridge-attachment section, the engaging surface being in abutment with the engaging portion of the cartridge-attachment section in the upright posture, the engaging surface being positioned below the engaging portion to be disengaged therefrom in the inclined posture.

16. The liquid cartridge according to claim 1, wherein the contact surface has a rear edge positioned rearward relative to an electrode disposed on the circuit board in the insertion direction in the upright posture.

17. The liquid cartridge according to claim 1, wherein the receiving portion comprises a protrusion having the contact surface facing downward, the receiving portion further having a first surface extending in the insertion direction and orthogonal to the contact surface in the upright posture, the contact surface and the first surface defining the receiving space below the protrusion.

18. The liquid cartridge according to claim 1, wherein the receiving portion comprises a rod member having the contact surface facing downward, the rod member being positioned above the receiving space.

19. The liquid cartridge according to claim 1, wherein the circuit board comprises a substrate and an electrode formed on the substrate, the substrate being fixed to the movable member.

20. A liquid cartridge configured to be inserted into a cartridge-attachment section in an insertion direction crossing a vertical direction and accommodated in the cartridge-attachment section in an upright posture, the liquid cartridge in the upright posture comprising:

a casing defining therein a liquid chamber configured to store liquid therein;

a liquid passage extending from the liquid chamber in the insertion direction;

a movable member movably supported by the casing, the movable member being movable relative to the casing in the vertical direction; and a circuit board provided at the movable member and facing upward, wherein the movable member is formed with a recess at a position closer to the circuit board than to the liquid passage in the vertical direction, the movable member having a contact surface defining the recess, the contact surface facing downward and extending in the insertion direction and a widthwise direction orthogonal to the insertion direction and the vertical direction, the recess being open in the insertion direction and in the widthwise direction.

21. The liquid cartridge according to claim 20, wherein the circuit board comprises a substrate and an electrode formed on the substrate, the substrate being fixed to the movable member.

22. The liquid cartridge according to claim 20, wherein the movable member further having a sloped surface defining the recess, the sloped surface being connected to the contact surface and positioned frontward of the contact surface in the insertion direction, the sloped surface sloping relative to the insertion direction to face diagonally downward and frontward in the upright posture.

23. A liquid cartridge configured to be inserted into a cartridge-attachment section in an insertion direction crossing a gravitational direction and accommodated in the cartridge-attachment section in an upright posture, the cartridge-attachment section including a protruding portion extending in the insertion direction and having a width in a widthwise direction orthogonal to the insertion direction and the gravitational direction, the liquid cartridge in the upright posture comprising:

a casing comprising:

a liquid chamber configured to store liquid therein; and a liquid passage extending from the liquid chamber in the insertion direction;

a movable member movably supported by the casing, the movable member comprising a receiving portion providing a receiving space that is open in the insertion direction and in the widthwise direction, the receiving portion having a contact surface defining the receiving space, the contact surface facing downward and extending in the insertion direction and the widthwise direction; and a circuit board provided at the movable member and facing upward, wherein the movable member is moved relative to the casing by contact of the contact surface with the protruding portion during entry of the protruding portion into the receiving portion in the insertion direction in accordance with the insertion of the liquid cartridge into the cartridge-attachment section.

24. The liquid cartridge according to claim 23, wherein the circuit board comprises a substrate and an electrode formed on the substrate, the substrate being fixed to the movable member.

25. The liquid cartridge according to claim 23, wherein the receiving portion further has a sloped surface connected to the contact surface and positioned frontward of the contact surface in the insertion direction, the sloped surface sloping relative to the insertion direction to face diagonally downward and frontward in the upright posture, the sloped surface being configured to guide the protruding portion to enter into the receiving space in the insertion direction.

* * * * *